US009514728B2

(12) United States Patent
Maruyama et al.

(10) Patent No.: US 9,514,728 B2
(45) Date of Patent: Dec. 6, 2016

(54) MUSICAL PERFORMANCE APPARATUS THAT EMITS MUSICAL PERFORMANCE TONES AND CONTROL TONES FOR CONTROLLING AN APPARATUS

(71) Applicant: YAMAHA CORPORATION, Hamamatsu-shi, Shizuoka-ken (JP)

(72) Inventors: Tsuyoshi Maruyama, Hamamatsu (JP); Takeshi Mori, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 206 days.

(21) Appl. No.: 13/734,196

(22) Filed: Jan. 4, 2013

(65) Prior Publication Data

US 2013/0174718 A1 Jul. 11, 2013

(30) Foreign Application Priority Data

Jan. 6, 2012 (JP) ..... 2012-000891

(51) Int. Cl.
*G10H 1/46* (2006.01)
*G10H 1/22* (2006.01)
(Continued)

(52) U.S. Cl.
CPC ..... *G10H 5/00* (2013.01); *G10H 1/0066* (2013.01); *G10H 1/46* (2013.01); *G10H 7/02* (2013.01); *G10H 2210/305* (2013.01); *G10H 2220/096* (2013.01); *G10H 2250/641* (2013.01)

(58) Field of Classification Search
USPC ..... 84/633
See application file for complete search history.

(56) References Cited

U.S. PATENT DOCUMENTS 3,757,046 A * 9/1973 Williams ..... H04R 3/12 381/18
5,402,702 A * 4/1995 Hata ..... A63J 17/00 446/175
(Continued)

FOREIGN PATENT DOCUMENTS

EP 1304680 A2 4/2003
EP 1947793 A1 7/2008
(Continued)

OTHER PUBLICATIONS

Japanese Office Action for corresponding JP 2012-000891, mail date Feb. 12, 2014. Partial translation of relevant portions.
(Continued)

*Primary Examiner* — Christopher Uhlir
(74) *Attorney, Agent, or Firm* — Rossi, Kimms & McDowell LLP

(57) ABSTRACT

A musical performance apparatus is provided with a tone generation circuit 15 and a sound system 16 for emitting musical tones of musical instruments and control tones corresponding to musical score data SD which controls a musical score display apparatus 20. The tone generation circuit 15 has a tone volume adjustment circuit 15*a*3 which changes tone volume of only the musical tones in accordance with player's instruction and maintains tone volume of the control tones at a certain tone volume. The tone generation circuit 15 also has a pan adjustment circuit 15*a*4 which localizes the control tones so that the control tones will be emitted only from a certain speaker. Furthermore, the musical performance apparatus is designed such that the control tones are formed only of frequency components included in a certain high frequency band. Furthermore, the tone volume of frequency components which are included in frequency components representative of the musical tones and are further included in the certain high frequency band is controlled to be lower than the tone volume of the control tones.

9 Claims, 26 Drawing Sheets

(51) Int. Cl.

| | |
|---|---|
| ***G10H 5/00*** | (2006.01) |
| ***G10H 1/00*** | (2006.01) |
| ***G10H 7/02*** | (2006.01) |

(56) References Cited

U.S. PATENT DOCUMENTS

| | | | | |
|---|---|---|---|---|
| 5,637,821 | A | 6/1997 | Izumisawa et al. | |
| 6,683,959 | B1 | 1/2004 | Kuwano et al. | |
| 7,507,894 | B2 | 3/2009 | Matsuura et al. | |
| 8,847,053 | B2 * | 9/2014 | Humphrey | G09B 5/065 434/308 |
| 2003/0196540 | A1 | 10/2003 | Ishii | |
| 2005/0211068 | A1 | 9/2005 | Zar | |
| 2008/0243491 | A1 | 10/2008 | Matsuoka | |
| 2011/0023691 | A1 * | 2/2011 | Iwase | G10H 1/0066 84/612 |
| 2011/0150240 | A1 | 6/2011 | Akiyama et al. | |

FOREIGN PATENT DOCUMENTS

| | | | |
|---|---|---|---|
| JP | 2001-086599 | A | 3/2001 |
| JP | 2003-316356 | A | 11/2003 |
| JP | 2007-104598 | A | 4/2007 |
| JP | 2010-055077 | A | 3/2010 |
| JP | 2010-087581 | A | 4/2010 |
| JP | 2010-087591 | A | 4/2010 |
| WO | 2005/055194 | A1 | 6/2005 |
| WO | 2005/074320 | A2 | 8/2005 |
| WO | 2010-016589 | A1 | 2/2010 |

OTHER PUBLICATIONS

Extended European Search Report issued in European counterpart application No. EP12197633.6, dated Jun. 25, 2013.

Extended European Search Report issued Jul. 2, 2013 for corres. EP12197635.1. Cited in related U.S. 13/734,284, U.S. Pat. No. 8,779,267.

* cited by examiner

FIG.9

| | | | | | | | | | | | |
|---|---|---|---|---|---|---|---|---|---|---|---|
| 0 | 1 | 0 | 0 | 1 | 0 | 0 | 1 | 1 | 0 | 1 | P1 |
| 1 | 0 | 1 | 1 | 0 | 1 | 1 | 0 | 0 | 1 | 0 | N1 |
| 1 | 1 | 1 | 0 | 0 | 0 | 1 | 1 | 0 | 0 | 0 | P0 |
| 0 | 0 | 0 | 1 | 1 | 1 | 0 | 0 | 1 | 1 | 1 | N0 |

FIG.20

| end side / top side | g1 | g2 | g3 | g4 | g5 | g6 | g7 | g8 |
|---|---|---|---|---|---|---|---|---|
| g1 | | | | ○ | | ○ | ○ | ○ |
| g2 | | | ○ | ○ | | ○ | | |
| g3 | | ○ | | | ○ | ○ | | ○ |
| g4 | ○ | ○ | | | | | | ○ |
| g5 | | | ○ | | ○ | ○ | | |
| g6 | ○ | ○ | ○ | | ○ | | | |
| g7 | ○ | | | | | | ○ | ○ |
| g8 | ○ | | ○ | ○ | | | ○ | |

MUSICAL PERFORMANCE APPARATUS THAT EMITS MUSICAL PERFORMANCE TONES AND CONTROL TONES FOR CONTROLLING AN APPARATUS

BACKGROUND OF THE INVENTION

Field of the Invention

The present invention relates to a musical performance apparatus which emits musical performance tones of a musical instrument such as melody and accompaniment, and control tones representative of control information for controlling an external apparatus.

Description of the Related Art

Conventionally, as described in Japanese Unexamined Patent Publication No. 2003-316356, for example, there is a known musical performance apparatus which outputs signals obtained by superimposing MIDI data on digital audio data to a tone generating module. As for the conventional musical performance apparatus, MIDI data is embedded in the least significant bit of digital audio data. As described in Japanese Unexamined Patent Publication No. 2007-104598, furthermore, there is a known information transmitting apparatus which emits control tones for controlling an external apparatus from a speaker.

SUMMARY OF THE INVENTION

However, because the above-described least significant bit represents a small change in the amplitude of sound signals, embedding MIDI data in the least significant bit will cause little influence on sound quality, but decoding of the MIDI data will be susceptible to interference. When signals output from the musical performance apparatus are interfered by noise, more specifically, there can be cases in which the tone generating module cannot decode MIDI data. In order to prevent noise interference as much as possible, therefore, the conventional musical performance apparatus is required to supply signals to the tone generating module with a shielded cable. Without using any cables, as in the case of the information transmitting apparatus described in Japanese Unexamined Patent Publication No. 2007-104598, it is difficult to allow the musical performance apparatus to convert the signals into acoustic signals by use of a speaker to emit tones, and to allow the tone generating module to receive the acoustic signals with a microphone to decode MIDI data in accordance with the received acoustic signals. Therefore, the conventional musical performance apparatus not only requires a user to connect the musical performance apparatus to the tone generating module with a cable but also restricts the position at which the tone generating module is placed.

The present invention was accomplished to solve the above-described problem, and an object thereof is to provide a musical performance apparatus which can easily and reliably control an external apparatus. As for descriptions for respective constituents of the present invention described below, numbers corresponding to components of a later-described embodiment are given in parenthesis for easy understanding. However, the respective constituents of the present invention are not limited to the corresponding components indicated by the numbers of the embodiment.

In order to achieve the above-described object, it is a feature of the present invention to provide a musical performance apparatus including tone generating portion (15, 16,17) emitting a musical tone of a musical instrument and a control tone which is formed only of a frequency component included in a certain high frequency band and corresponds to control data (SD) controlling an external apparatus, and has tone volume changing portion (12,15*a*3,AMP) changing tone volume only of the musical tone in accordance with player's instruction and maintaining tone volume of the control tone at a certain tone volume.

In this case, the control tone may be a modulated tone obtained by modulating a carrier wave by use of the control data. In this case, furthermore, a first mode in which only the musical tone is emitted and a second mode in which the musical tone and the control tone are emitted may be provided; and the tone generating portion may have a plurality of tone generation channels (CH0 to CH31) each of which generates the musical tone or the control tone so that all the tone generation channels will generate the musical tone in the first mode while at least one of the tone generation channels will generate the control tone in the second mode.

In this case, furthermore, the tone generating portion may have tone pitch changing portion (ADR, SPI) changing tone pitch of only the musical tone in accordance with the player's instruction and maintaining tone pitch of the control tone at a certain tone pitch. In this case, furthermore, the tone generating portion may have tone color changing portion (FLT) changing tone color of only the musical tone in accordance with the player's instruction and maintaining a certain tone color of the control tone.

In this case, furthermore, the external apparatus may have a display unit (22) to display a score, the control data may have a score page designating data which designate the page position of the score to be displayed on the display unit.

In this case, furthermore, the score page designating data may be generated by spreading the data representative of the page position of the score to be displayed on the display unit and modulating the spread data by using differential phase shift modulation scheme.

By this configuration, the tone volume changing portion changes the tone volume only of a part in charge of the musical tone but maintains the tone volume of the control tone at a certain tone volume (e.g., at the maximum tone volume). Furthermore, the tone pitch changing portion changes the tone pitch only of the musical tone, but maintains the certain tone pitch of the control tone (i.e., tone pitch of a tone formed only of a frequency component included in the high-frequency band). Furthermore, the tone color changing portion changes the tone color only of the musical tone, but maintains the certain tone color of the control tone (i.e., tone color of the tone formed only of the frequency component included in the high-frequency band). Therefore, the musical performance apparatus according to the present invention insures high accuracy of decoding control data by an external apparatus to reliably control the external apparatus. Consequently, the musical performance apparatus can easily transmit control data to the external apparatus without the need to connect to the external apparatus with a cable. Compared with a case of the musical performance apparatus connected with the external apparatus with a cable, furthermore, restrictions on the arrangement of the external apparatus can be relaxed. Furthermore, because the control tone is formed only of frequency components included in the certain high-frequency band (e.g., a narrow frequency band around 17.64 kHz), users can rarely recognize generated control tones in spite of the tone volume of the control tones being fixed at the maximum. Therefore, the control tones will not hinder musical performance.

Furthermore, another feature of the present invention is that the tone generating portion has a plurality of speakers (16) for emitting the musical tone and the control tone; and localization setting portion (15*a*4) localizing sound image of the control tone at a certain position by setting respective tone volumes of the control tone which is to be emitted from the speakers at certain tone volumes, respectively.

In this case, furthermore, the localization setting portion may allow the control tone to be emitted only from one speaker which is selected from the plurality of speakers.

In this case, the respective control tone volumes are specified so that interference between the control tones will be reduced as much as possible. Therefore, the musical performance apparatus according to the present invention prevents degradation in accuracy of decoding control data by the external apparatus.

A further feature of the present invention is that tone volume of a frequency component which is included in frequency components of the musical tone and is further included in the certain high frequency band is lower than the tone volume of the control tone. Because the musical performance apparatus according to the present invention can reduce interference between the musical tone and the control tone, the musical performance apparatus further enhances the accuracy of decoding of the control data by the external apparatus.

BRIEF DESCRIPTION OF THE DRAWINGS

FIG. 9 is a diagram indicative of example differential codes;

FIG. 20 is a diagram indicative of combinations of basic waveform data sets which form the control waveform data sets indicated in FIG. 19A and FIG. 19B;

DESCRIPTION OF THE PREFERRED EMBODIMENT a. General Configuration

Figure 1:
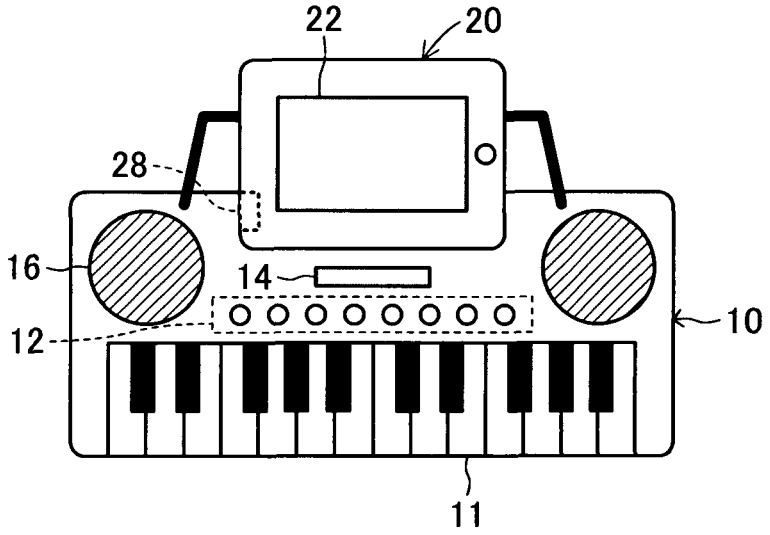
FIG. 1 is a diagram indicative of an overview of a musical performance apparatus and a musical score display apparatus used along with the musical performance apparatus according to an embodiment of the present invention.

A general configuration of a musical performance apparatus 10 according to an embodiment of the present invention will be briefly described with reference to FIG. 1. The musical performance apparatus 10 emits musical tones of musical instruments (hereafter simply referred to as musical tones) in accordance with musical performance information representative of musical performance such as melody and accompaniment. Furthermore, the musical performance apparatus 10 also emits control tones obtained by modulating carrier waves by use of musical score data SD which controls a musical score display apparatus 20 which is to be used along with the musical performance apparatus 10. The musical score display apparatus 20 inputs the control tones emitted by the musical performance apparatus 10 and displays a musical score on a display unit 22 in accordance with the control tones.

Figure 2:
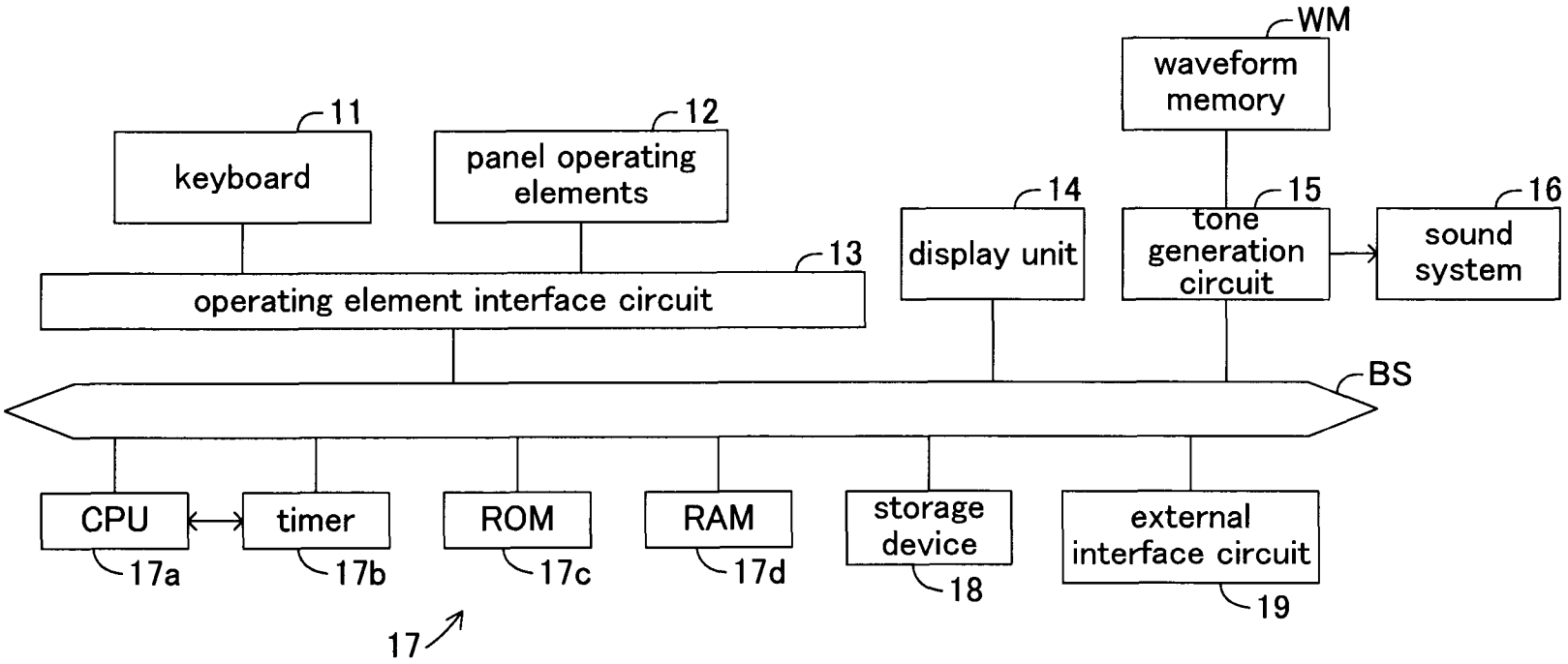
FIG. 2 is a block diagram indicative of an entire configuration of the musical performance apparatus.

Next, the musical performance apparatus 10 will be explained in detail. As indicated in FIG. 2, the musical performance apparatus 10 has a keyboard 11, panel operating elements 12, an operating element interface circuit 13, a display unit 14, a tone generation circuit 15, a sound system 16, a computer portion 17, a storage device 18 and an external interface circuit 19.

The keyboard 11 is operated by player's hands, and is formed of a plurality of white keys and a plurality of black keys for designating tone pitches of musical tone signals which will be generated and instructing generation and stop of the musical tone signals. The panel operating elements 12 are a plurality of operating elements provided on an operating panel of an electronic musical instrument. The panel operating elements which are also operated by the player's hands and include operating elements for specifying musical tone characteristics such as tone color, tone volume, effect and the like of musical tone signals which will be generated are operating elements for specifying the entire operation of the musical performance apparatus 10. The musical performance apparatus 10 has a control mode for controlling the musical score display apparatus 20 and a single mode in which the musical score display apparatus 20 will not be controlled. A user is allowed to select either of the modes by use of the panel operating elements 12. The musical performance apparatus 10 is provided with an automatic musical performance capability of automatically playing music in accordance with previously stored musical performance information so that the user can select a musical piece for automatic musical performance and instruct to start and stop the play of the musical piece by use of the panel operating elements 12. By use of the panel operating elements 12, furthermore, the user can specify tone volume balance, localization and the like of performance parts of the automatic performance. For instance, a master volume operating element included in the panel operating elements 12 is an operating element for concurrently changing all the musical tones which are currently being generated. These operating elements include not only on/off operating elements but also rotary operating elements and sliding operating elements. Furthermore, the panel operating elements 12 also include actuating elements which correspond to various operating elements such as switches corresponding to on/off operating elements, volumes or rotary encoders corresponding to rotary operating elements, and volumes or linear encoders corresponding to sliding operating elements.

The keyboard 11 and the panel operating elements 12 are connected to the operating element interface circuit 13 connected to a bus BS. Therefore, operating information indicative of user's operation of the keyboard 11 and the panel operating elements 12 is supplied to a later-described computer portion 17 via the operating element interface circuit 13 and the bus BS. The display unit 14 is configured by a liquid crystal display (LCD), and displays letters, graphics and the like on a screen. The display of the display unit 14 is controlled by the computer portion 17 via the bus BS.

The tone generation circuit 15 reads out musical tone waveform data and control waveform data designated by a CPU 17*a* from a waveform memory WM which stores sets of waveform data, generates digital tone signals and supplies the generated digital tone signals to the sound system 16. As described in detail later, the tone generation circuit 15 includes an effector circuit for adding various kinds of effects such as chorus effect and reverb effect to musical tones. The waveform memory WM and the tone generation circuit 15 will be explained in detail later. The sound system 16 has a D/A converter for converting digital tone signals supplied from the tone generation circuit 15 to analog tone signals, an amplifier for amplifying the converted analog tone signals, and a right speaker and a left speaker which convert the amplified analog tone signals to acoustic signals and output the converted acoustic signals.

The computer portion 17 is formed of the CPU 17*a*, a timer 17*b*, a ROM 17*c* and a RAM 17*d* which are connected to the bus BS. The CPU 17*a* supplies information necessary for generation of musical tones to the tone generation circuit 15 in accordance with musical performance information supplied from the operating element interface circuit 13 and the external interface circuit 19. Particularly, the CPU 17*a* supplies parameters related to musical tones (hereafter referred to as musical tone parameters) to the tone generation circuit 15 in accordance with key-events generated by player's key-depressions/releases on the keyboard 11 and events generated on the basis of musical performance information supplied from an external apparatus via the external interface circuit 19 or musical performance information stored in the storage device 18 and reproduced by the musical performance apparatus 10.

The storage device 18 includes large-capacity nonvolatile storage media such as HDD, FDD, CD-ROM, MO and DVD, and drive units for the storage media to enable storage and reading of various kinds of data and programs. The data and programs may be previously stored in the storage device 18 or externally retrieved via the external interface circuit 19. The various kinds of data and programs stored in the storage device 18 are read by the CPU 17*a* to be used for control of the electronic musical instrument. The above-described various kinds of data include musical piece data representative of musical performance of musical pieces. The musical piece data is formed of note event data related to generation of musical tones, musical score event data related to musical score which is to be displayed, delta time data representative of time between various event data, and the like. The external interface circuit 19 includes a MIDI interface circuit and a communication interface circuit. Via the external interface circuit 19, the musical performance apparatus 10 is able to connect to a MIDI-capable external apparatus such as a different electronic musical apparatus and a personal computer, and is also able to connect to a communication network such as the Internet.

Next, the waveform memory WM will be explained in detail. In the waveform memory WM, sets of musical tone waveform data are stored. A set of musical tone waveform data is formed of a plurality of sample values obtained by sampling a musical tone at a certain sampling frequency (e.g., 44.1 kHz). A plurality of sample values related to one musical tone are orderly stored in successive addresses of the waveform memory WM.

Figure 3A:
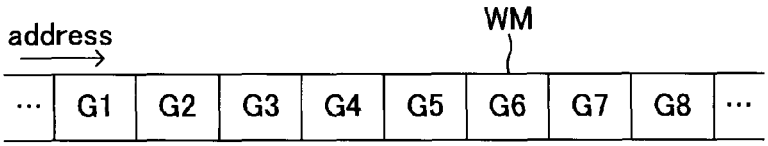
FIG. 3A is a memory map indicative of an arrangement of control waveform data sets.
Figure 3B:
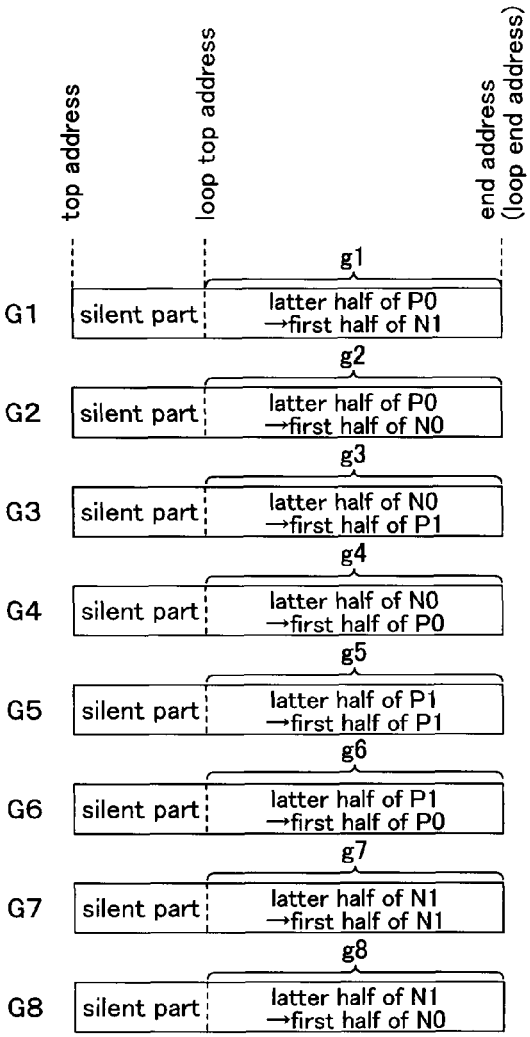
FIG. 3B is a diagram indicative of respective configurations of control waveform data sets.
Figure 4:
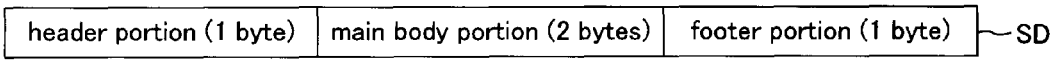
FIG. 4 is a diagram indicative of a configuration of musical score data.

In the waveform memory WM, furthermore, control waveform data sets G1 to G8 indicated in FIG. 3A and FIG. 3B and representative of waveforms of tone which form a part of a control tone are stored. The generation of the control waveform data sets G1 to G8 will be explained below. The musical score data SD is formed of a header portion, a main body portion and a footer portion as indicated in FIG. 4. The header portion is data of 1 byte which includes information representative of the length of the main body portion. The main body portion is data of 2 bytes including musical piece information representative of a musical piece number and page information representative of page position of a musical score. The footer portion is data of 1 byte including information representative of the end of the musical score data SD. Hereafter, the musical score data SD will be explained as data having 32 bits as a whole. More specifically, the 0th bit of the footer portion is referred to as the least significant bit LSB of the musical score data SD, while the 7th bit of the header portion is referred to as the most significant bit MSB of the musical score data SD. The most significant bit MSB and the least significant bit LSB are dummy data, and will be ignored by the musical score display apparatus 20.

Figure 5:
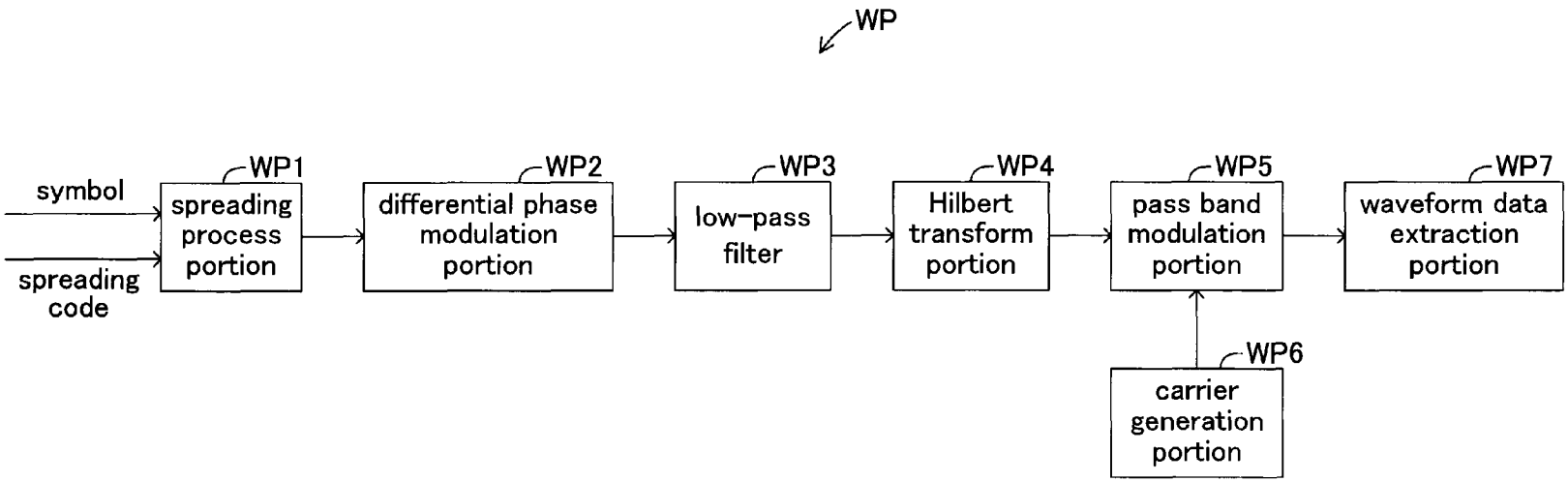
FIG. 5 is a block diagram indicative of an entire configuration of a control waveform data generating apparatus.
Figure 6:
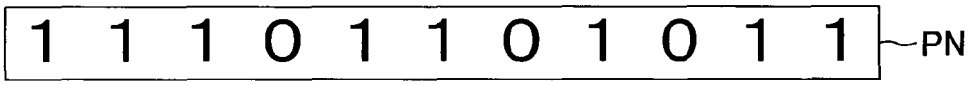
FIG. 6 is a diagram indicative of an example spreading code.

The control waveform data sets G1 to G8 are generated by a control waveform data generating apparatus WP which is provided separately from the musical performance apparatus 10 and the musical score display apparatus 20 and is indicated in FIG. 5, and are stored in the waveform memory WM. The musical score data SD is orderly input one bit by one bit into a spreading process portion WP1, starting with the least significant bit LSB toward the most significant bit MSB. Hereafter, each bit of the musical score data SD will be referred to as a symbol. To the spreading process portion WP1, furthermore, a spreading code PN will be also input. The spreading code PN is a pseudorandom number code string having a certain periodicity. In this embodiment, the spreading code PN is a code of 11 chips as indicated in FIG. 6. Each bit of the spreading code PN is referred to as a chip. A symbol rate "fa" which is a communication speed at which the musical score data SD is transmitted in a base band is 400.9 sps (symbol/second) (see FIG. 7). The periodicity of the spreading code PN coincides with the symbol rate "fa". Therefore, a chip rate "fb" of the spreading code PN is 4,410 cps (chip/second).

Figure 7:
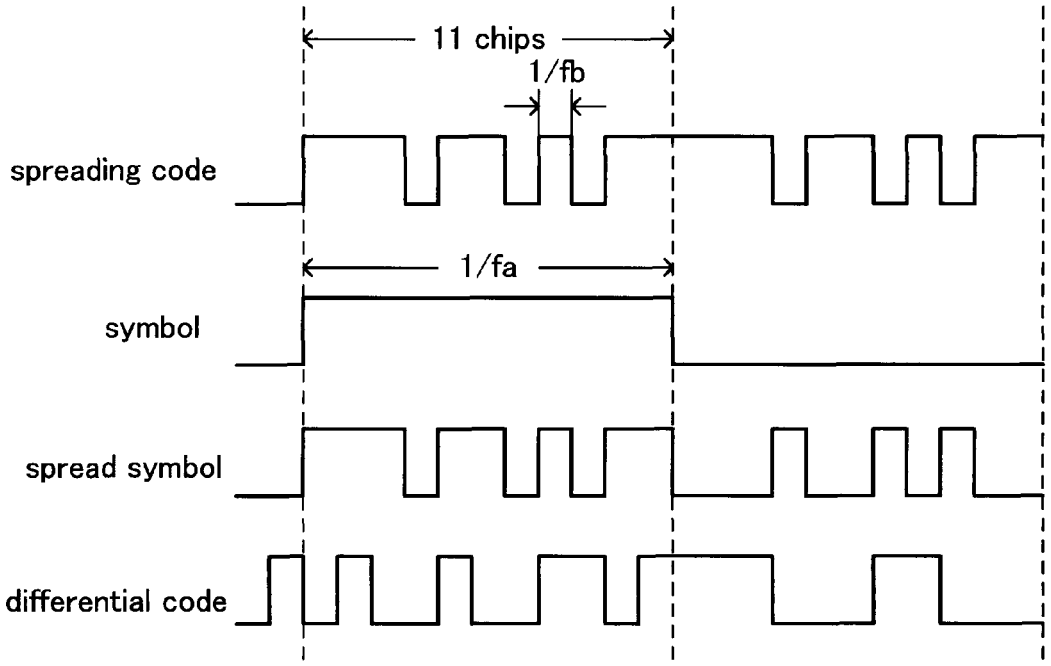
FIG. 7 is a timing chart indicative of operation of a spreading process portion and a differential phase modulation portion indicated in FIG. 5.

The symbols input to the spreading process portion WP1 are spread by use of the spreading code PN. As indicated in FIG. 7, more specifically, in a case where a value of a symbol is "1", the spreading code PN is directly output from the spreading process portion WP1. In a case where a value of a symbol is "0", a code obtained by reversing the phase of the spreading code PN is output from the spreading process portion WP1.

Figure 8:
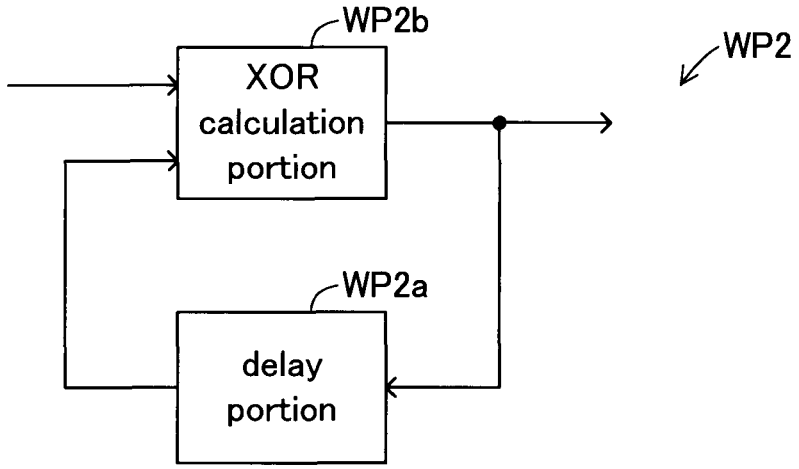
FIG. 8 is a block diagram indicative of a configuration of the differential phase modulation portion indicated in FIG. 5.

The symbols spread by the spreading process portion WP1 are input to a differential phase modulation portion WP2 one chip by one chip, starting with the top chip toward the last chip. As indicated in FIG. 8, the differential phase modulation portion WP2 is formed of a delay portion WP2*a* and an XOR calculation portion WP2*b*. The delay portion WP2*a* delays a calculated result output from the XOR calculation portion WP2*b* which will be explained next by a period of 1 chip, and then outputs the delayed result to the XOR calculation portion WP2*b*. The XOR calculation portion WP2*b* performs the exclusive-OR operation between a value of a code input from the delay portion WP2*a* and a value of a code input from the spreading process portion WP1, and then outputs the calculated result. Each symbol spread by the spreading process portion WP1 is converted into any one of four codes by the differential phase modulation portion WP2 as indicated in FIG. 9. More specifically, a symbol whose value is "1" is converted into differential code P1 or differential code N1, while a symbol whose value is "0" is converted into differential code P0 or differential code N0.

The differential code output from the XOR calculation portion WP2*b* is input to a low-pass filter WP3. The low-pass filter WP3 is a filter for restricting frequency band of control tone output from a later-described pass band modulation portion WP5. The differential code output from the low-pass filter WP3 is input to a Hilbert transform portion WP4. The Hilbert transform portion WP4 transforms the differential code by shifting the phase of the differential code. The pass band modulation portion WP5 modulates a carrier output from a carrier generation portion WP6 by use of a signal output from the Hilbert transform portion WP4, and shifts the frequency band of the differential code to a high frequency band included in an audio band, also extracting the upper sideband and outputting a control tone formed of frequency components included in the upper sideband. By reducing the frequency band of the differential code by half as described above, the embodiment reduces influence caused by noise to enhance accuracy of decoding of the musical score data SD by a later-described decoding circuit 29. Because the frequency of the carrier is 17.64 kHz, the control tone is hard to be heard in general. Then, a waveform data extraction portion WP7 samples the control tone, and stores sample values of sampling periods as waveform data of the control tone in a buffer memory. The sampling frequency is 44.1 kHz.

Although the differential codes P1, P0, N1, and N0 are sequentially output from the differential phase modulation portion WP2, the manner in which the type of differential codes transitions is limited to the 8 different transitions indicated in FIG. 3B. Therefore, digital signals (e.g., one or more sets of musical score data) are input to the spreading process portion WP1 of the control waveform data generation apparatus WP so that indicative of the above-described 8 different transitions are output from the differential phase modulation portion WP2 to store waveform data indicative of control tone in a buffer memory. Then, the waveform data extraction portion WP7 extracts certain sample values from among the waveform data indicative of the control tone stored in the buffer memory as basic waveform data g1 to g8. With a part at which differential codes switch being assumed as a center, more specifically, a plurality of sample values situated in front of and behind the centers are extracted. In this embodiment, the sampling frequency is 44.1 kHz. In a case where 110 sample values are extracted with parts at which differential codes switch being assumed as centers, as described above, the top of each set of basic waveform data g1 to g8 is equivalent to the center of a differential code of the first half, while the end of each set of basic waveform data g1 to g8 is equivalent to the center of a differential code of the latter half.

Figure 10:
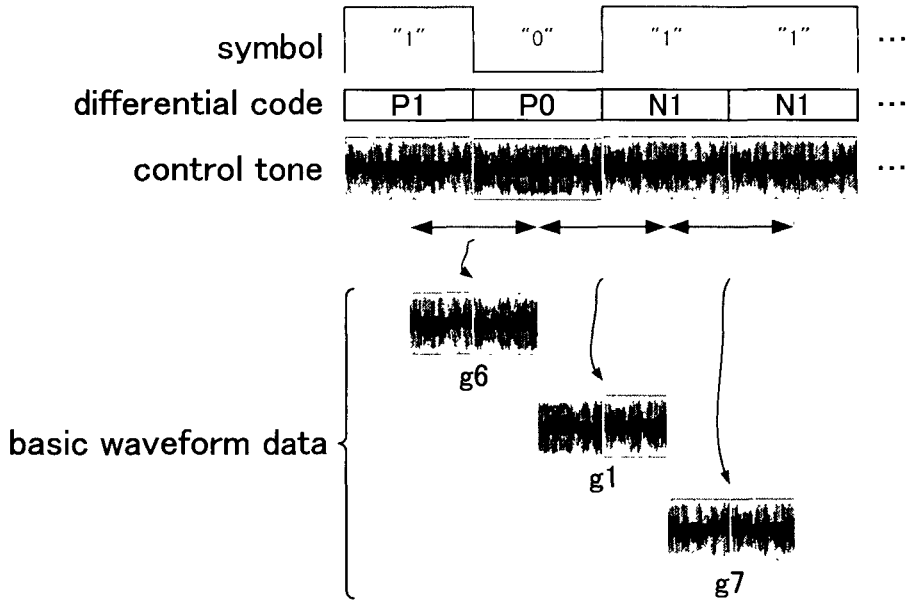
FIG. 10 is a diagram explaining retrieval of basic waveform data.

As indicated in FIG. 10, more specifically, a part equivalent to the latter half of the differential code P0 and the first half of the differential code N1 is extracted as basic waveform data g1. The other sets of basic waveform data g2 to g8 are also extracted similarly to the basic waveform data g1. More specifically, a part equivalent to the latter half of the differential code P0 and the first half of the differential code N0 is extracted as basic waveform data g2. Furthermore, a part equivalent to the latter half of the differential code N0 and the first half of the differential code P1 is extracted as basic waveform data g3, while a part equivalent to the latter half of the differential code N0 and the first half of the differential code P0 is extracted as basic waveform data g4. Furthermore, a part equivalent to the latter half of the differential code P1 and the first half of the differential code P1 is extracted as basic waveform data g5, while a part equivalent to the latter half of the differential code P1 and the first half of the differential code P0 is extracted as basic waveform data g6. Furthermore, a part equivalent to the latter half of the differential code N1 and the first half of the differential code N1 is extracted as basic waveform data g7, while a part equivalent to the latter half of the differential code N1 and the first half of the differential code N0 is extracted as basic waveform data g8. To the top of each of the basic waveform data sets g1 to g8 extracted as described above, a silent part having a certain length which is common to the basic waveform data sets is added to be stored in the waveform memory WM as control waveform data sets G1 to G8. However, the silent part may not be added. Sample values which form each of the control waveform data sets are stored in successive addresses in the order in which the sample values are sampled for each control waveform data set. The control waveform data sets G1 to G8 have the same data size. The control waveform data sets have the same offset address indicative of the offset amount between the top address and the top address of the basic waveform data. The musical performance apparatus 10 can form waveform data indicative of the entire control tone whose carrier waves have been modulated by use of desired musical score data SD by combining the control waveform data sets G1 to G8 extracted as described above.

b. Configuration of Tone Generation Circuit

Figure 11:
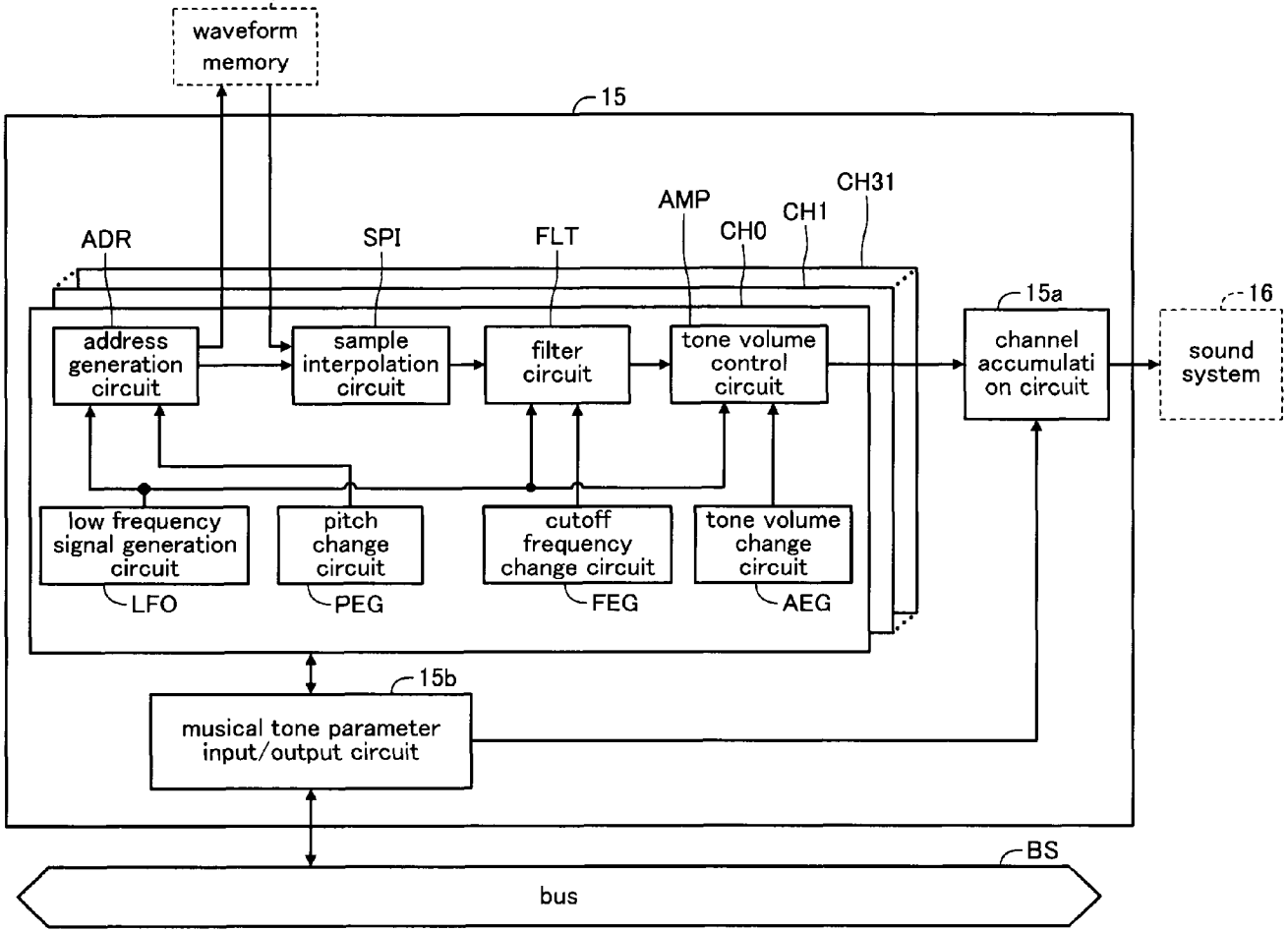
FIG. 11 is a block diagram indicative of a configuration of a tone generation circuit indicated in FIG. 2.

Next, the configuration of the tone generation circuit 15 will be described in detail. The entire configuration of the tone generation circuit 15 will now be explained. As indicated in FIG. 11, the tone generation circuit 15 has a plurality of tone generation channels CH0, CH1, . . . , CH31 (e.g., 32 channels) which read out waveform data from the waveform memory WM to generate digital tone signals. In addition, the tone generation circuit 15 also has a channel accumulation circuit 15*a* which accumulates digital tone signals generated at the tone generation channels CH0, CH1, . . . , CH31 and outputs the accumulated signals to the sound system 16. Furthermore, the tone generation circuit 15 also has a musical tone parameter input/output circuit 15*b* which inputs musical tone parameters output from the CPU 17*a* for control of the tone generation channels and outputs the input musical tone parameters to the tone generation channels CH0, CH1, . . . , CH31 at certain timing. Next, the tone generation channels CH0, CH1, . . . , CH31, the channel accumulation circuit 15*a*, and the musical tone parameter input/output circuit 15*b* will be explained in detail.

b1. Tone Generation Channels

Each of the tone generation channels CH0, CH1, . . . , CH31 which are configured similarly with each other generates a digital tone signal at each sampling period. Hereafter, generation of a digital tone signal at the tone generation channel will be simply referred to as tone generation. Each of the tone generation channels CH0, CH1, . . . , CH31 has a low frequency signal generation circuit LFO, a pitch change circuit PEG, a cutoff frequency change circuit FEG and a tone volume change circuit AEG. Furthermore, each of the tone generation channels CH0, CH1, . . . , CH31 also has an address generation circuit ADR, a sample interpolation circuit SPI, a filter circuit FLT and a tone volume control circuit AMP.

The low frequency signal generation circuit LFO generates low frequency signals which periodically change tone pitch, tone color and tone volume after the start of tone generation, and supplies the generated low frequency signals to the address generation circuit ADR, the filter circuit FLT and the tone volume control circuit AMP. To the low frequency signal generation circuit LFO, low frequency signal control parameters are supplied from the CPU 17*a* via the musical tone parameter input/output circuit 15*b*. The low frequency signal control parameters include data which specifies waveform, frequency and amplitude of low frequency signals which will be output from the low frequency signal generation circuit LFO.

The pitch change circuit PEG supplies tone pitch control signals for controlling tone pitch of digital tone signals to the address generation circuit ADR. The pitch change circuit PEG generates tone pitch control signals which vary with the passage of time so that the tone pitch of element signals will change with the passage of time after the start of tone generation, and then, supplies the generated tone pitch control signals to the address generation circuit ADR. The series of tone pitch control signals which vary with the passage of time are referred to as a pitch envelope. The cutoff frequency change circuit FEG supplies cutoff frequency control signals for controlling frequency response of digital tone signals to the filter circuit FLT. The cutoff frequency change circuit FEG generate cutoff frequency control signals which vary with the passage of time so that the cutoff frequency of a filter will vary with the passage of time after the start of tone generation, and then supplies the generated cutoff frequency control signals to the filter circuit FLT. The series of cutoff frequency control signals which vary with the passage of time are referred to as a cutoff envelope. The tone volume change circuit AEG supplies tone volume control signals for controlling tone volume of digital tone signals to the tone volume control circuit AMP. The tone volume change circuit AEG generates tone volume control signals which vary with the passage of time so that the tone volume of digital tone signals will vary with the passage of time after the start of tone generation, and then supplies the generated tone volume control signals to the tone volume control circuit AMP. The series of tone volume control signals which vary with the passage of time are referred to as a tone volume envelope.

The address generation circuit ADR combines a tone pitch value which indicates a tone pitch of a depressed key and is included in the musical tone parameters supplied from the CPU 17*a* via the musical tone parameter input/output circuit 15*b*, the tone pitch control signal supplied from the pitch change circuit PEG and the low frequency signal supplied from the low frequency signal generation circuit LFO, and figures out the amount of pitch shift. To the address generation circuit ADR, waveform data information is supplied from the CPU 17*a* via the musical tone parameter input/output circuit 15*b*. The waveform data information is formed of a top address and an end address of waveform data which will be read out from the waveform memory WM, a loop top address, a loop end address and an original pitch indicative of the tone pitch of the waveform data.

The address generation circuit ADR is able to cyclically generate addresses situated between the loop top address and the loop end address. As a result, each tone generation channel can loop-reproduce (loop-play) data situated at a section of the waveform data. This capability is referred to as loop capability. The amount of pitch shift is the difference between the original pitch and a pitch of a musical tone which is to be generated. In accordance with the amount of pitch shift, the address generation circuit ADR determines a rate at which the waveform data is read out. The address generation circuit ADR then reads out the waveform data from the waveform memory WM at the determined reading rate. However, because the reading rate determined according to the pitch shift amount usually includes a decimal fraction, the address at which the waveform data is read out also includes an integer and a decimal. For reading out the waveform data, therefore, a pair of neighboring sample values of the waveform data is read out by use of the integer, so that the read sample values are supplied to the sample interpolation circuit SPI. As for the reading of control waveform data, however, the amount of pitch shift is "0", so that the control tone will be directly emitted at the original pitch. The sample interpolation circuit SPI performs interpolation by use of the supplied pair of sample values and the decimal of the address, generates digital musical tone data, and supplies the generated digital musical tone data to the filter circuit FLT.

The filter circuit FLT combines the cutoff frequency control signal supplied from the cutoff frequency change circuit FEG and the low frequency signal supplied from the low frequency signal generation circuit LFO, and figures out a cutoff frequency for filtering. To the filter circuit FLT, filter control parameters are also supplied from the CPU 17*a* via the musical tone parameter input/output circuit 15*b*. The filter control parameters include filter selection information for selecting the type of filter (e.g., high-pass filter, low-pass filter). The filter circuit FLT designates the cutoff frequency of the filter selected in accordance with the filter selection information as the obtained cutoff frequency, filters the waveform data supplied from the sample interpolation circuit SPI with this filter, and outputs the resultant data to the tone volume control circuit AMP. However, the control waveform data will not be filtered.

The tone volume control circuit AMP combines the tone volume control signal supplied from the tone volume change circuit AEG and the low frequency signal supplied from the low frequency signal generation circuit LFO, and figures out the tone volume of a musical tone signal which is to be generated. Then, the tone volume control circuit AMP amplifies the waveform data supplied from the filter circuit FLT in accordance with the obtained tone volume, and outputs the amplified data to the channel accumulation circuit 15*a*. However, the control waveform data will be amplified not to have the obtained tone volume but to have a predetermined tone volume (the maximum tone volume, for example).

In a case where the musical performance apparatus 10 is in the control mode for controlling the musical score display apparatus 20, any one of the tone generation channel (e.g., the tone generation channel CH31) is reserved for control tones. In other words, the reserved tone generation channel generates only control tones, and will not generate any musical tones. Therefore, the number of musical tones which can be generated concurrently is limited to 31.

b2. Channel Accumulation Circuit 15*a*

Figure 12A:
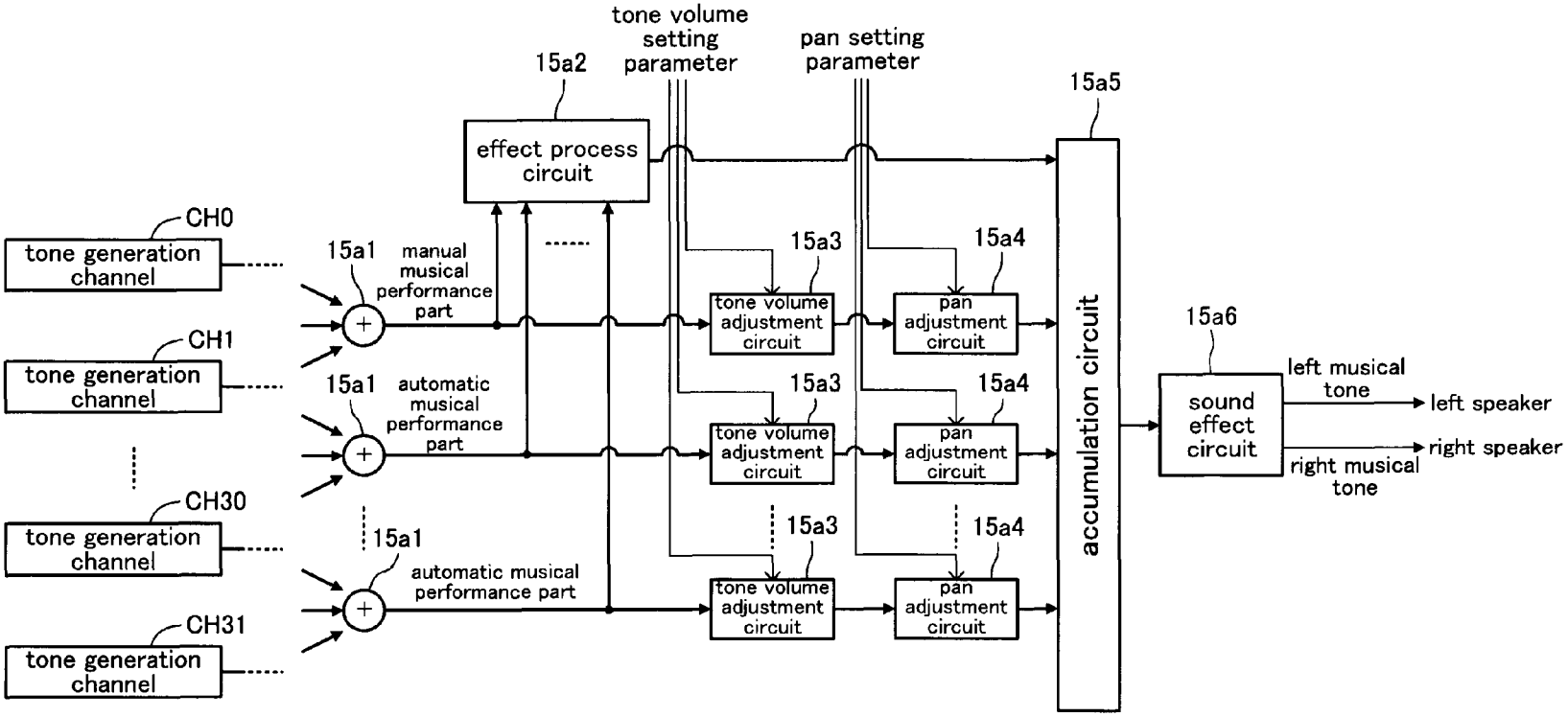
FIG. 12A is a block diagram indicative of a configuration of a channel accumulation circuit operating in single mode.

As indicated in FIG. 12A, the channel accumulation circuit 15*a* has a part accumulation circuit 15*a*1, an effect process circuit 15*a*2, a tone volume adjustment circuit 15*a*3, a pan adjustment circuit 15*a*4, an accumulation circuit 15*a*5, and a sound effect circuit 15*a*6. The part accumulation circuit 15*a*1 accumulates digital tone signals output from the tone generation channels CH0, CH1, . . . CH31 at each sampling period for a manual musical performance part and for each of automatic musical performance parts, and outputs the accumulated signals to the effect process circuit 15*a*2 and to the tone volume adjustment circuit 15*a*3. The effect process circuit 15*a*2 adds an effect (e.g., chorus effect, reverb effect) which will be commonly added to the manual musical performance part and the automatic performance parts. The tone volume adjustment circuit 15*a*3 amplifies respective tone volumes of the parts in accordance with tone volume setting parameters input from the musical tone parameter input/output circuit 15*b*, and then outputs the signals to the pan adjustment circuit 15*a*4. The pan adjustment circuit 15*a*4 adjusts localization of the digital tone signals of the parts in accordance with pan setting parameters input from the musical tone parameter input/output circuit 15*b*, and then outputs the adjusted signals to the accumulation circuit 15*a*5. The accumulation circuit 15*a*5 accumulates the input digital tone signals of the parts, and outputs the accumulated signals to the sound effect circuit 15*a*6. The sound effect circuit 15*a*6 adds an effect to the accumulated digital tone signals, and outputs the signals to the sound system 16.

Figure 12B:
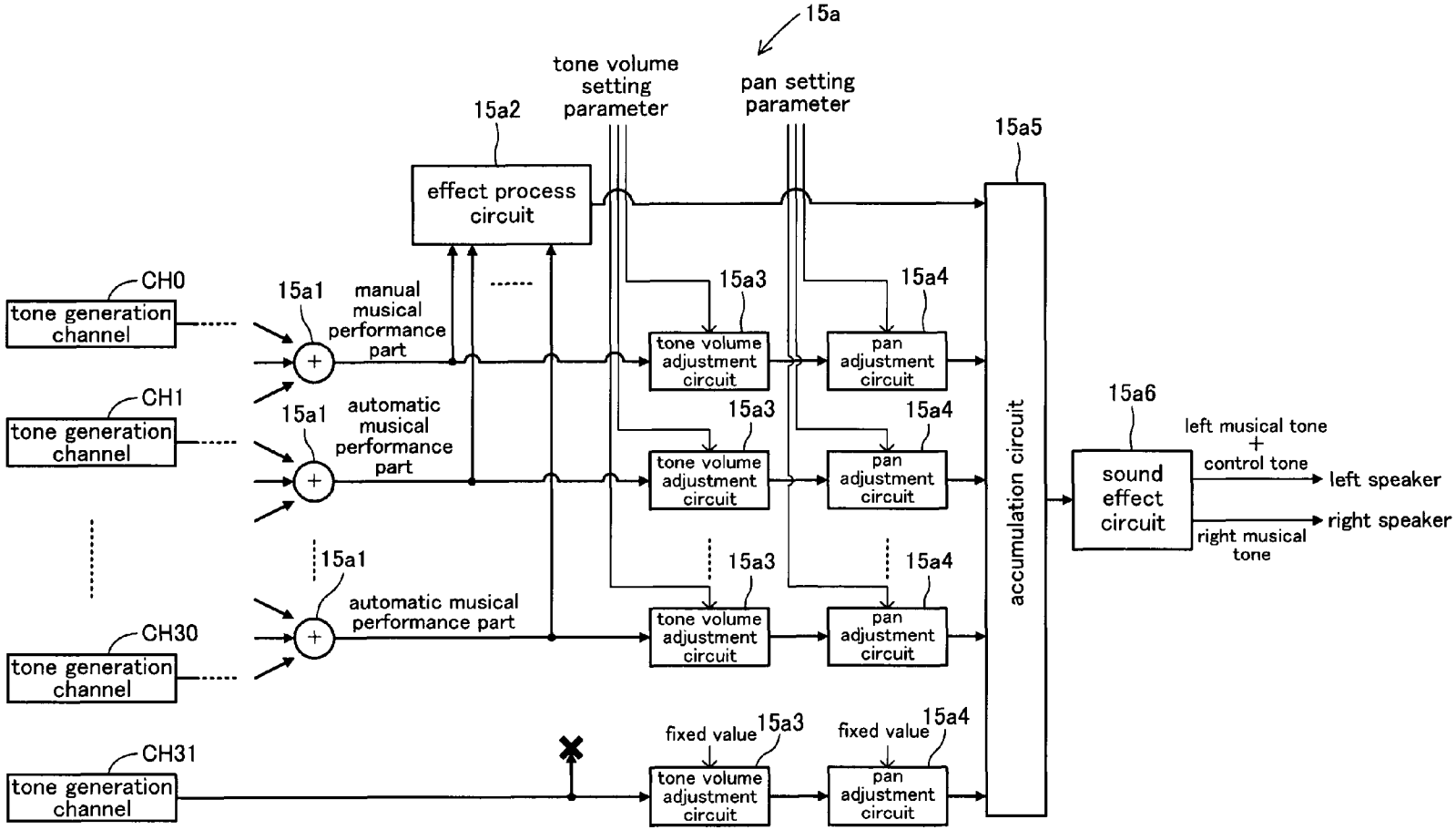
FIG. 12B is a block diagram indicative of a configuration of a channel accumulation circuit operating in control mode.

In a case where the musical performance apparatus 10 is in the control mode for controlling the musical score display apparatus 20, however, the tone generation channel CH31 is designated as a tone generation channel for generating digital tone signals of control tones. As indicated in FIG. 12B, therefore, digital tone signals output from the tone generation channel CH31 will not be output to the effect process circuit 15*a*2 but will be output only to the tone volume adjustment circuit 15*a*3. Although tone volume setting parameters for specifying tone volume balance of musical performance parts are supplied to the tone volume adjustment circuits 15*a*3 of the musical performance parts, respectively, the value of the tone volume setting parameter supplied to the tone volume adjustment circuit 15*a*3 for control tone is a fixed value. The fixed tone volume setting parameter value is "127" for example which is the highest value. Although pan setting parameters for specifying localization of musical performance parts is supplied to the pan adjustment circuits 15*a*4 of the musical performance parts, respectively, the value of the pan setting parameter supplied to the pan adjustment circuit 15*a*4 for control tones is also a fixed value. The fixed pan setting parameter value is a value which is to be output only from either speaker (e.g., left speaker), for example. In a case where any problems caused by interference of control tones which will be emitted from the right and left speakers will not arise, control tones may be emitted to some degree from the other speaker as well.

b3. Musical Tone Parameter Input/Output Circuit 15*b*

Next, the musical tone parameter input/output circuit 15*b* will be explained. The musical tone parameter input/output circuit 15*b* inputs musical tone parameters supplied from the CPU 17*a* via the bus BS, and outputs the input musical tone parameters to the various circuits of the tone generation channels CH0, CH1, . . . , CH31. The musical tone parameter input/output circuit 15*b* has a processing register which stores waveform data information transmitted to the tone generation channels CH0, CH1, . . . , CH31 and related to control tones which are currently being generated by the tone generation channels CH0, CH1, . . . , CH31. The musical tone parameter input/output circuit 15*b* also has a reservation register which stores waveform data information related to control tones which will be generated next by the tone generation channels CH0, CH1, . . . , CH31. Furthermore, the musical tone parameter input/output circuit 15*b* inputs parameters indicative of respective states of the circuits (address generation circuit ADR, pitch change circuit PEG, cutoff frequency change circuit FEG, tone volume change circuit AEG, etc.) of the tone generation circuit 15, and outputs the parameters to the CPU 17*a*.

Figure 13:
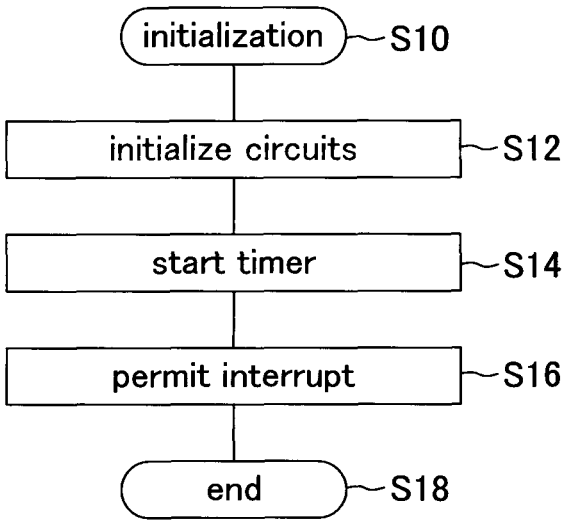
FIG. 13 is a flowchart of an initialization program.

Next, the operation of the musical performance apparatus 10 configured as above will be explained. When a user turns on a power switch (not shown) of the musical performance apparatus 10, the CPU 17*a* executes an initialization program indicated in FIG. 13. The CPU 17*a* starts an initialization process at step S10, and initializes the circuits of the musical performance apparatus 10 at step S12. More specifically, the CPU 17*a* reads out data related to tone color which will be assigned to the keyboard 11 and image data which will be displayed on the display unit 14 from the ROM 17*c*, and uses the read data as initial values. At step S14, the CPU 17*a* starts the timer 17*b* and makes settings so that the timer 17*b* will generate timer interrupts at certain intervals (e.g., intervals of 1 millisecond). At step S16, the CPU 17*a* permits interrupt transmitted from the operating element interface circuit 13. At step S18, the CPU 17*a* terminates the initialization process.

When the CPU 17*a* detects that the operating element interface circuit 13 has made an interrupt caused by user's operation of a key-depression/release, the CPU 17*a* carries out a musical tone generation program which is not shown, and starts or stops generation of a musical tone in accordance with the user's operation of key-depression/release. When the CPU 17*a* detects that the interrupt has been caused by user's instruction to switch mode, the CPU 17*a* carries out a mode switch program which is not shown, and switches the operating mode in accordance with the user's mode switching instruction.

Figure 14:
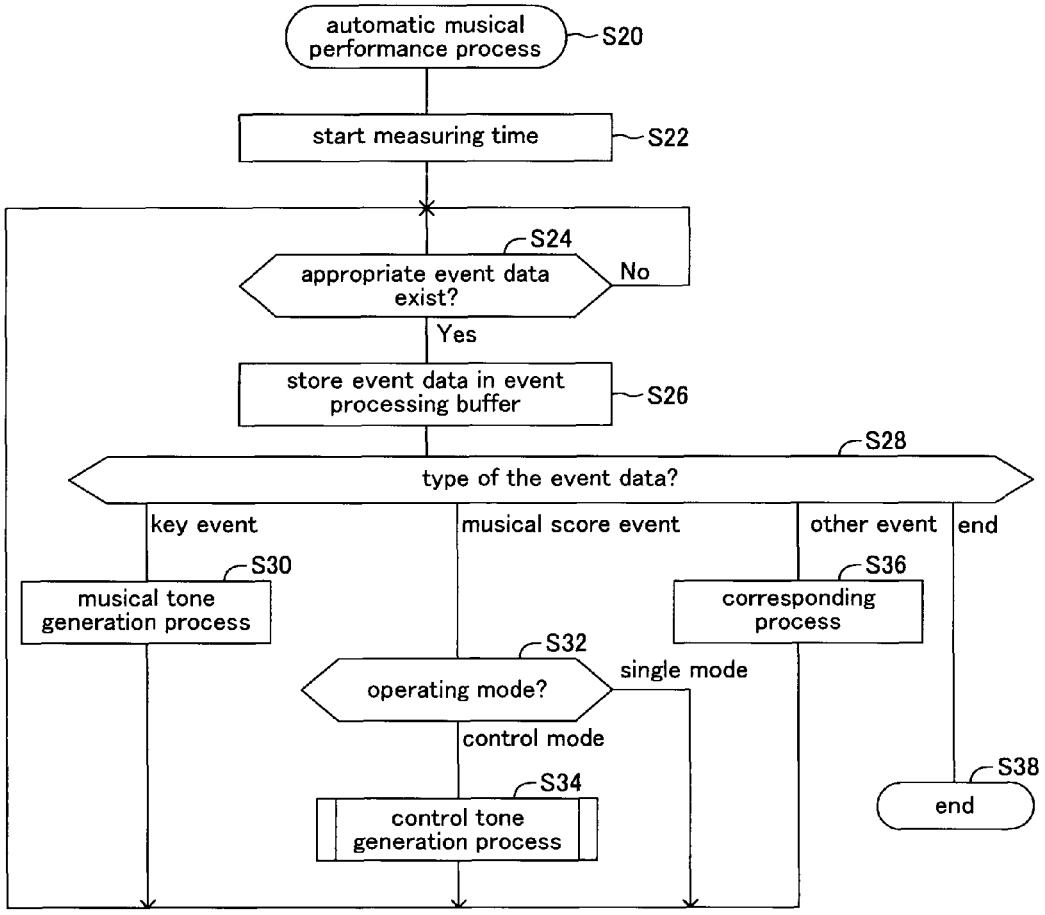
FIG. 14 is a flowchart of an automatic musical performance program.

When the CPU 17*a* detects that the interrupt made by the operating element interface circuit 13 has been caused by user's instruction to start automatic performance, the CPU 17*a* carries out an automatic musical performance program indicated in FIG. 14.

After starting an automatic musical performance process at step S20, the CPU 17*a* proceeds to step S22 to start measuring time by use of the timer 17*b*. At step S24, the CPU 17*a* reads out user's selected musical piece data from the storage device 18 (or the previously copied RAM 17*d*), and finds event data whose tempo clock timing coincides with current time from among event data included in the read musical piece data. In a case where there is no corresponding event data, the CPU 17*a* gives "no" and carries out step S24 again. In a case where there is appropriate event data, the CPU 17*a* gives "yes" and proceeds to step S26 to read out the event data to store the read event data in an event processing buffer. At step S28, in accordance with the type of the event data stored in the event processing buffer, the CPU 17*a* determines a process which will be carried out next. In a case where the event data is key event data related to key-depression or key-release, more specifically, the CPU 17*a* proceeds to step S30 to carry out the musical tone generation program which is not shown to start or stop generation of a musical tone corresponding to the key event data. After the start or stop of generation of a musical tone, the CPU 17*a* returns to step S24.

In a case where the event data detected at step S28 is musical score event data including musical score data SD indicative of a musical score page which is to be displayed on the musical score display apparatus 20, the CPU 17*a* proceeds to step S32 to judge whether the current operating mode is single mode or control mode. In a case where the musical performance apparatus 10 is in the single mode, the CPU 17*a* returns to step S24. In a case where the musical performance apparatus 10 is in the control mode, the CPU 17*a* proceeds to step S34 to carry out a control tone generation program indicated in FIG. 15.

Hereafter, generation of control tones will be concretely explained with reference to FIG. 15 and FIG. 16. An example of FIG. 16 is provided, assuming that a string of symbol values ranging from the least significant bit LSB side to the most significant bit MSB side of the musical score data SD is "0101 . . . ". To pairs of neighboring two bits ranging from the least significant bit LSB side to the most significant bit MSB side of the musical score data SD, control waveform data G4, control waveform data G1, control waveform data G8, control waveform data G3, and so on correspond. More specifically, the control waveform data G4 corresponds to the 0th bit and the 1st bit, while the control waveform data G1 corresponds to the 1st bit and the 2nd bit. The control waveform data G8 corresponds to the 2nd bit and the 3rd bit, while the control waveform data G3 corresponds to the 3rd bit and the 4th bit. In FIG. 16, furthermore, step numbers are provided at positions corresponding to timing at which the later-described steps will be carried out.

After starting the control tone generation process at step S40, the CPU 17*a* proceeds to step S42 to select top two symbols (i.e., the 0th bit and the 1st bit) of the musical score data SD as the target symbols which are to be processed first. At step S44, the CPU 17*a* selects a set of control waveform data (in the example of FIG. 16, control waveform data G4) corresponding to the selected two symbols from among the control waveform data sets G1 to G8, and writes various addresses of the selected set of control waveform data into the processing register for the tone generation channel CH31 provided in the musical tone parameter input/output circuit 15*b*. The various addresses are a top address, an end address, a loop top address and a loop end address. The loop top address is the top address of basic waveform data which forms the control waveform data. The loop end address is the end address of the basic waveform data.

At step S46, the CPU 17*a* instructs the tone generation channel CH31 to start generating digital tone signals using the control waveform data selected at step S44. The address generation circuit ADR of the tone generation channel CH31 increments the offset address at each sampling period to advance reading address one by one starting at the top address written in the processing register. The address generation circuit ADR then reads out a sample value stored in the reading address. As described above, the tone generation channel CH31 generates digital tone signals corresponding to the control waveform data selected at step S44.

At step S48, the CPU 17*a* judges whether or not the reading address has advanced further than the loop top address written in the processing register. More specifically, the CPU 17*a* judges whether the offset address is greater than a difference between the top address and an address corresponding to the end of a silent part. In a case where the reading address has not advanced further than the loop top address, the CPU 17*a* carries out step S48 again. In a case where the reading address has advanced further than the loop top address, the CPU 17*a* proceeds to step S50 to judge whether the target symbols which are to be processed include the most significant bit MSB of the musical score data SD. In a case where the target symbols do not include the most significant bit MSB of the musical score data SD, the CPU 17*a* gives "no" to proceed to step S52. At step S52, the CPU 17*a* moves the two target symbols by 1 bit toward the most significant bit MSB side of the musical score data SD to select the next two target symbols. For example, because the first target symbols selected at step S42 are the 0th bit and the 1st of the musical score data SD, the symbols selected at the first execution of step S52 are the 2nd bit and the 1st bit of the musical score data SD.

At the next step S54, the CPU 17*a* selects a set of control waveform data corresponding to the target symbols selected at the above-described step S52, and writes various kinds of addresses of the selected control waveform data into the reservation register of the tone generation channel CH31 provided in the musical tone parameter input/output circuit 15*b*. At the next step S56, the CPU 17*a* judges whether or not the reading address has reached the loop end address written into the processing register. In a case where the reading address has not reached the loop end address yet, the CPU 17*a* gives "no", and carries out step S56 again. In a case where the reading address has reached the loop end address, the CPU 17*a* gives "yes", and returns to step S48.

In the tone generation channel CH31, when the reading address has reached the loop end address, the address generation circuit ADR copies the various addresses written in the reservation register to the processing register. At this stage, however, the offset address will not be changed. The address generation circuit ADR specifies the reading address used at the next sampling period as follows. First, the address generation circuit ADR adds the offset address to the top address copied to the processing register. In this case, the address obtained by the addition is equivalent to the end address (loop end address) copied to the processing register. Therefore, the offset address is set at an offset between the top address and the loop top address copied to the processing register. As a result, the reading address which will be used at the next sampling period is to be the loop top address copied to the processing register.

By repeating the above-described steps S48 to S56, the CPU 17*a* sequentially selects the control waveform data set (in the example of FIG. 16, control waveform data G4, control waveform data G1, control waveform data G8, control waveform data G3, and so on) corresponding to the target two symbols. At each selection of the control waveform data set, the CPU 17*a* writes various addresses of the data into the reservation register. At step S50, in a case where the target symbols include the most significant bit MSB of the musical score data SD, the CPU 17*a* gives "yes", and proceeds to step S58 to clear the reservation register. For instance, the CPU 17*a* writes "0" as each of the top address, the end address, the loop top address and the loop end address into the reservation register. In a case where the reservation register has "0", the tone generation channel CH31 stops tone generation after the reading out and reproduction of the last data of the control waveform data which is currently being reproduced. The CPU 17*a* then proceeds to step S60 to terminate the control tone generation process.

The automatic musical performance process (FIG. 14) will be explained again. In a case where the event data stored in the event process buffer is data other than the above-described data, the CPU 17*a* proceeds to step S36 to carry out a process corresponding to the event data, and then returns to step S24. In a case where the event data is program change data for changing tone color, the CPU 17*a* generates musical tone control parameters indicative of change in tone color, outputs the generated parameters to the tone generation circuit 15, and returns to step S24. In a case where the event data stored at step S26 is end data, the CPU 17*a* proceeds to step S38 to terminate the automatic musical performance process.

Figure 17:
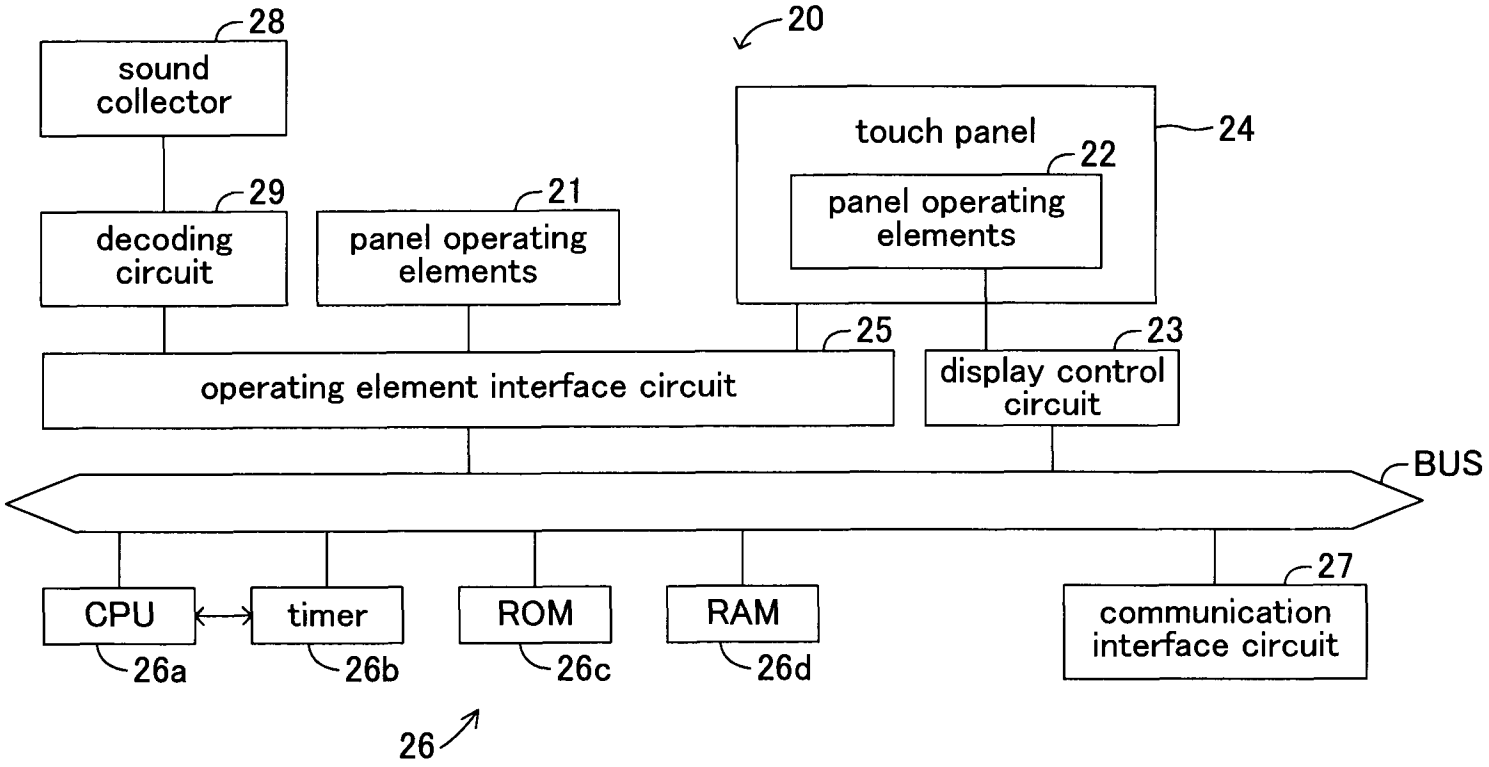
FIG. 17 is a block diagram indicative of an entire configuration of the musical score display apparatus.

Next, the musical score display apparatus 20 will be explained. The musical score display apparatus 20 is a personal digital assistant such as a small computer and a mobile phone, and has panel operating elements 21, a display unit 22, a display control circuit 23, a touch panel 24, an operating element interface circuit 25, a computer portion 26, a communication interface circuit 27, a sound collector 28 and a decoding circuit 29 as indicated in FIG. 17. The panel operating elements 21 include a power switch for turning on/off the musical score display apparatus 20 and a button for controlling the brightness of the display unit 22. The panel operating elements 21 are connected to the operating element interface circuit 25 so that the user's operation of the panel operating elements 21 can be detected.

The display unit 22 is configured by a liquid crystal display (LCD), and displays letters, graphics and the like on a display screen. The display of the display unit 22 is controlled by the display control circuit 23. A display area of the display unit 22 of the musical score display apparatus 22 is larger than a display area of the display unit 14 of the musical performance apparatus 10. The display control circuit 23 inputs image data representative of an image which will be displayed on the display unit 22 from the later-described computer portion 26 via the bus BUS.

The touch panel 24 is placed to overlap with the display screen of the display unit 22. Furthermore, the touch panel 24 is also connected to the operating element interface circuit 25, so that the touch panel 24 will be controlled by the operating element interface circuit 25 to output coordinate data representative of coordinate indicative of a position touched by the user to the operating element interface circuit 25.

The operating element interface circuit 25 supplies various kinds of data related to operation of the panel operating elements 21 and operation of the touch panel 24 to the computer portion 26 via the bus BUS.

Similarly to the computer portion 17 of the musical performance apparatus 10, the computer portion 26 is configured by a CPU 26*a*, a timer 26*b*, a ROM 26*c* and a RAM 26*d*. Furthermore, the communication interface circuit 27 enables the musical score display apparatus 20 to connect to a MIDI-capable external apparatus such as a personal computer by radio or with a cable, also enabling the musical score display apparatus 20 to connect to a communication network such as the Internet.

Figure 18:
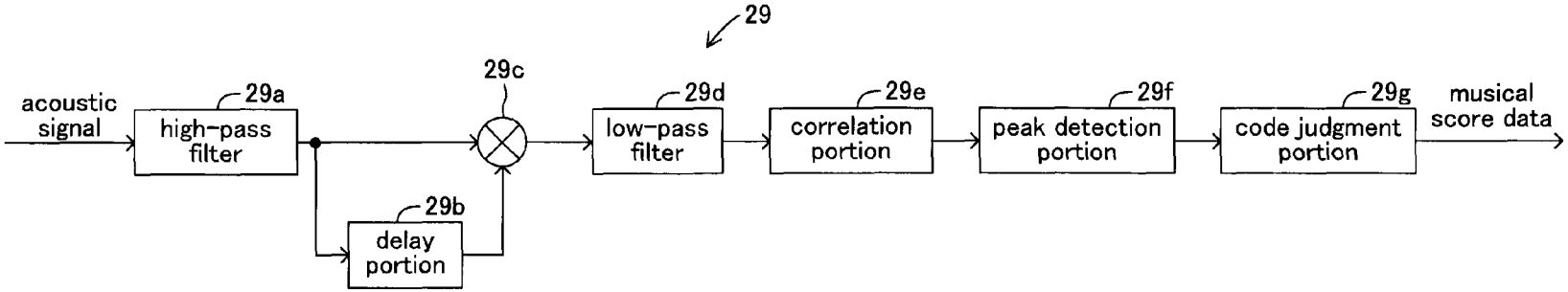
FIG. 18 is a block diagram indicative of a configuration of a decoding circuit indicated in FIG. 17.

The sound collector 28 is configured by a microphone for inputting sound signals and an amplification circuit. The sound collector 28 is placed at a position which is a corner of the musical score display apparatus 20 and is situated, when the musical score display apparatus 20 is mounted on the musical performance apparatus 10, near the left speaker of the musical performance apparatus 10 (see FIG. 1). The decoding circuit 29 inputs acoustic signals collected and amplified by the sound collector 28, and decodes musical score data SD by using control tones emitted from the musical performance apparatus 10. Acoustic signals input to the decoding circuit 29 are input to a high-pass filter 29*a* as indicated in FIG. 18. From the input acoustic signals, the high-pass filter 29*a* removes frequency components included in a frequency band which is lower than a frequency band of the control tones, and outputs the resultant signals to a delay portion 29*b* and a multiplication portion 29*c*.

The delay portion 29*b* delays an input signal by time equivalent to 1 chip of a difference code, and then outputs the delayed signal to the multiplication portion 29*c*. The multiplication portion 29*c* carries out delay detection by multiplying the signal input from the high-pass filter 29*a* by the signal input from the delay portion 29*b*. The signal output from the multiplication portion 29*c* is converted into a baseband signal by a low-pass filter 29*d* to be input to a correlation portion 29*e*. The correlation portion 29*e* outputs a correlation coefficient by use of the spreading code PN (see FIG. 6). The correlation coefficient output from the correlation portion 29*e* is input to a peak detection portion 29*f*. The peak detection portion 29*f* extracts a positive or negative peak component of the input correlation coefficient at the cycle of the spreading code PN. The Value of the extracted peak component is input to a code judgment portion 29*g*. The judgment portion 29*g* defines the value of a code (i.e., a symbol which forms the musical score data SD) as "0" when the value of an input peak component is "1", while the value of a code is defined as "1" when the value of the input peak component is "−1".

Because each set of control waveform data ranges from the midpoint of a symbol to the midpoint of a neighboring symbol, control tones equivalent to the first and last 5 bits (or 6 bits) of differential codes corresponding to the least significant bit LSB and the most significant bit MSB of the musical score data SD will not be emitted. Therefore, respective values of the least significant bit LSB and the most significant bit MSB of the decoded musical score data SD can be different from values of the least significant bit LSB and the most significant bit MSB of the musical score data SD transmitted from the musical performance apparatus 10. However, because the 0th bit and the 31st bit are dummy bits as described above, any problems will not arise. The decoded musical score data SD as described above is output to the CPU 26*a* via the bus BUS, while the CPU 26*a* reads out image data corresponding to the input musical score data SD from the ROM 26*c*, and outputs the read image data to the display control circuit 23. Resultantly, an image corresponding to the decoded musical score data SD is displayed on the display unit 22. In accordance with the progression of musical performance by the musical performance apparatus 10, more specifically, images indicative of musical score are displayed on the display unit 22. Furthermore, the embodiment may be modified to carry out a program by which acoustic signals collected and amplified by the sound collector 28 are input not to the decoding circuit 29 but to the computer portion 26 so that the CPU 26*a* will decode the input acoustic signals into the musical score data SD without using the decoding circuit 29.

The musical performance apparatus 10 configured as above eliminates the necessity to connect the musical performance apparatus 10 with the musical score display apparatus 20 with a cable, enabling easy transmission of musical score data SD to the musical score display apparatus 20. Compared with a case of the musical performance apparatus 10 connected with the musical score display apparatus 20 with a cable, furthermore, restrictions on the arrangement of the musical score display apparatus 20 can be relaxed. In addition, the musical performance apparatus 10 also eliminates the necessity to have a modulator unlike the above-described conventional information transmitting apparatus, achieving cost-reduction. Furthermore, because the musical performance apparatus 10 generates control tones corresponding to desired musical score data SD by combining sets of control waveform data, the musical performance apparatus 10 can significantly save the space of the waveform memory WM, compared with a case where waveform data representative of the whole control tones for which carrier waves have been modulated is stored for each of musical score data sets SD having different values. Furthermore, each set of control waveform data is configured of basic waveform data in which differential codes switch at the midpoints of the data. Unlike a case where differential codes switch at the end of each control waveform data set, therefore, the present embodiment eliminates discontinuous sections of control tones corresponding to the parts at which differential codes switch. Therefore, the musical performance apparatus 10 is able to increase accuracy of decoding musical score data SD by the musical score display apparatus 20.

By use of the loop capability of the tone generation channel CH 31, furthermore, the embodiment is designed such that sets of control waveform data each representative of neighboring two symbols which form the musical score data SD are successively read out. In a case where the tone generation of the sets of control waveform data is assigned to one or more tone generation channels so that the instruction to start the tone generation will be made for each of the control waveform data sets, it is necessary to synchronize the end of tone generation of a set of control waveform data and the start of tone generation of the next set of control waveform data. In other words, the CPU 17*a* or the tone generation circuit 15 has to adjust the timing at which each of the control waveform data sets is read out. By the above-described configuration, however, the embodiment enables easy and reliable reproduction of sets of control waveform data, without interruption of the sets of control waveform data. Therefore, this embodiment enables simple configurations of the CPU 17*a* and the tone generation circuit 15, and simplifies the configuration of the control tone control program. As described above, furthermore, because control tones corresponding to the musical score data SD will not be interrupted, this embodiment can enhance the accuracy of decoding of the musical score data SD done by the musical score display apparatus 20. In the case of the above-described configuration, furthermore, parts equivalent to boundaries of the symbols of the control tones can be affected by the processing by the low-pass filter WP3 and the Hilbert transform portion WP4. Therefore, this embodiment is designed such that the basic waveform data sets g1 to g8 are extracted with the boundaries of the symbols (differential codes) being defined as midpoints. As a result, this embodiment prevents the parts equivalent to the boundaries of the symbols of the musical score data SD which is to be transmitted from noise ranging across a wide frequency band, eliminating the possibility of interfered musical performance.

Furthermore, this embodiment is designed such that in a case where the musical performance apparatus 10 is in the control mode, the tone volume of the tone generation channel CH 31 for generating control tones is constant. More specifically, even if the user operates the master volume operating element, the tone volume of only musical tone parts will change, with the tone volume of control tones being fixed at the maximum tone volume. Furthermore, the address generation circuit ADR and the interpolation circuit SPI of the tone generation channel CH31 are set to make the pitches of control tones stay at their original pitches. As a result, this embodiment is able to keep constant accuracy of decoding of musical score data SD done by the musical score display apparatus 20. Furthermore, because the frequency band of control tones is around 18 kHz which is high and narrow, users can rarely recognize generated control tones in spite of the tone volume of the control tones being fixed at the maximum. Therefore, the control tones will not hinder musical performance.

Furthermore, this embodiment is designed such that control tones are generated only from the left speaker. As a result, this embodiment prevents interference of control tones occurring when the control tones are concurrently emitted from a plurality of speakers. Therefore, this embodiment prevents degradation in accuracy of decoding musical score data SD done by the musical score display apparatus 20.

In carrying out the invention, the invention is not limited to the above-described embodiment, but can be variously modified without departing from the object of the present invention.

In the above-described embodiment, for example, by use of the loop capability of the tone generation channel CH31, sets of control waveform data are successively read out and reproduced without interruption. However, the embodiment may be modified such that in addition to control tones, by use of the loop capability of the tone generation channels CH1 to CH30, sets of musical tone waveform data will be successively read out and reproduced without interruption. By this modification, the musical performance apparatus 10 is able to generate musical tones of various tone colors by changing the order of the arrangement of the sets of musical tone waveform data which will be read out successively. Furthermore, compared with a case where sets of musical waveform data of these tone colors are stored in the waveform memory WM, this modification significantly saves space of the waveform memory WM.

Furthermore, this embodiment is designed such that musical score data SD is embedded in musical piece data as musical score event data so that the control tone generation process will be performed in response to the detection of the musical score event data. However, the embodiment may be modified such that one of the panel operating elements 12 is assigned a function of switching pages of musical score so that the detection of user's operation of the operating element will trigger execution of the control tone generation process.

Furthermore, the above-described embodiment is designed such that each time target symbols which will be processed are selected by the step S52, a corresponding set of control waveform data is selected by the step S54. However, the embodiment may be modified to determine the sequence of sets of control waveform data corresponding to the musical score data SD prior to the instruction to start tone generation by the step S46. Instead of the step S52 and the step S54, in this case, the top address, the end address, the loop top address, and the loop end address of control waveform data will be written in accordance with the previously determined sequence into the musical tone parameter input/output circuit 15*b*. In this case, a table representative of relationship between certain musical score data SD and the sequence of control waveform data sets may be stored so that the sequence of control waveform data sets will be determined in accordance with the table. This modification can eliminate the need for selecting target symbols to select a set of control waveform data corresponding to the selected symbols, enabling simplification of the control tone generation program.

In the above-described embodiment, furthermore, user's operation of the master volume operating element only results in a change in the tone volume of musical tone parts, with the tone volume of control tones being fixed at the maximum. However, the tone volume of control tones may be affected by the operation of the master volume operating element. In this case, the embodiment will be modified such that the reduction in tone volume of control tones is smaller than the reduction in tone volume of musical tone parts.

Furthermore, the cutoff frequency of the filter circuits FLT of the tone generation channels which are to generate musical tones may be controlled so that the tone volume of frequency components which are the frequency components of the musical tones and are included in the frequency band of control tones is sufficiently smaller than the tone volume of the control tones. Alternatively, when the musical tones are sampled, the tone volume of frequency components included in the frequency band of control tones may be sufficiently reduced. For instance, it is preferable that the difference between the tone volume of frequency components which are the frequency components of musical tones and are included in the frequency band of control tones, and the tone volume of control tones is 10 dB or more. The cutoff frequency of the filter circuits FLT of the tone generation channels which will generate musical tones may be adjusted so that the frequency band of musical tones will not overlap with the frequency band of control tones. When musical tones are sampled, frequency components included in the frequency band of control tones may be previously removed. By these modifications, the accuracy of decoding musical score data SD by the musical score display apparatus 20 can be further enhanced.

Figure 19A:
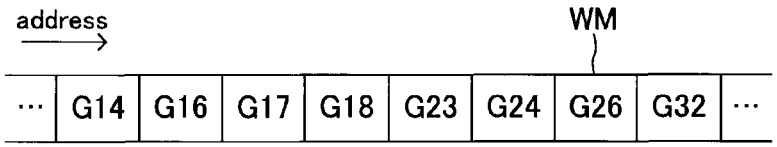
FIG. 19A is a memory map indicative of an arrangement of control waveform data sets according to a modification of the present invention.
Figure 19B:
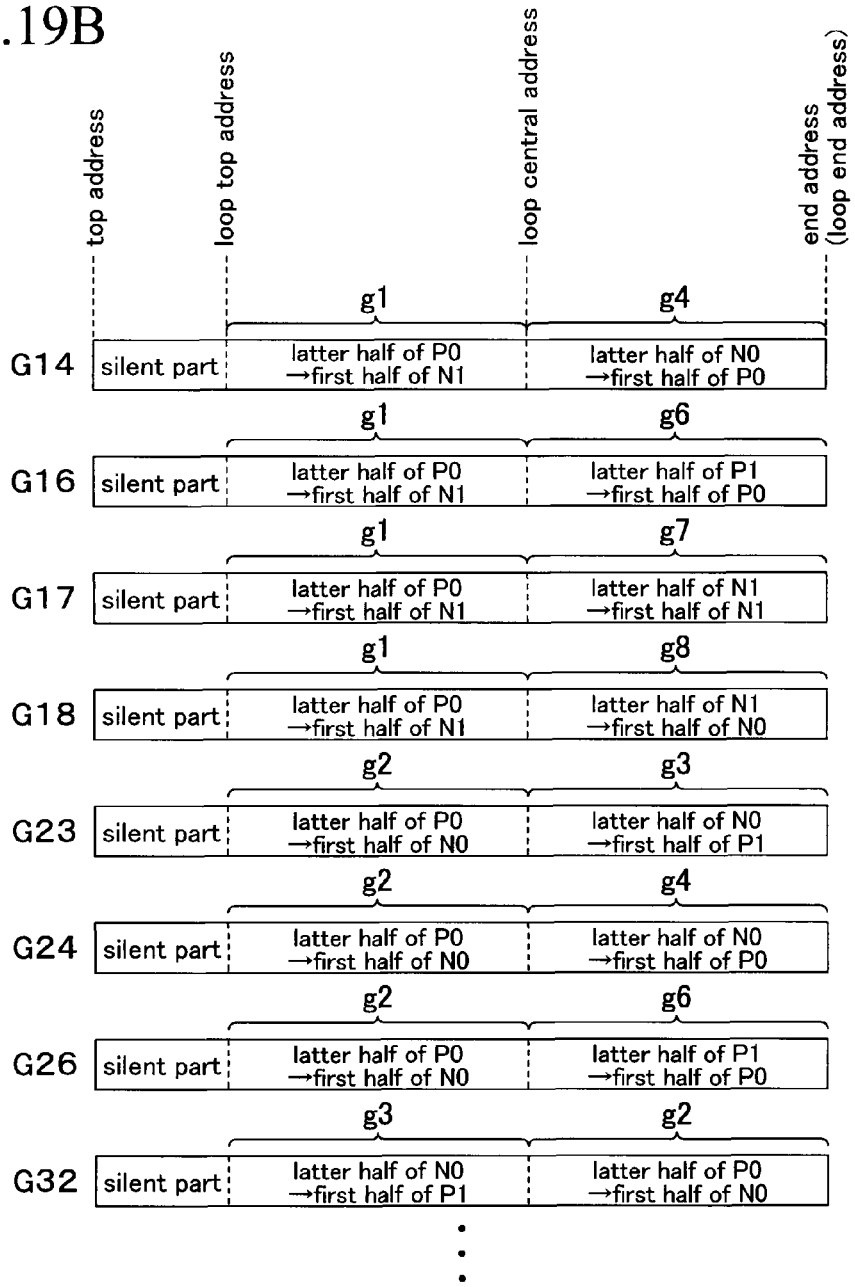
FIG. 19B is a diagram indicative of respective configurations of the control waveform data sets according to the modification of the present invention.

Furthermore, as indicated in FIG. 19A and FIG. 19B, for example, sets of control waveform data G14, G16, . . . , G23, G24, . . . , G84, G87 each having two of the basic waveform data sets g1 to g8 may be stored in the waveform memory WM. By combining two of the basic waveform data sets g1 to g8, up to 56 different sets of control waveform data can be formed. However, because control waveform data sets having a combination of basic waveform data sets which cannot exist in a row are unnecessary, only 28 different control waveform data sets indicated by circles in FIG. 20 will be stored in the waveform memory WM. At the top of each control waveform data set, a silent part of a length which is common to the control waveform data sets is provided. Similarly to the above-described embodiment, however, the silent part may be omitted.

Figure 15:
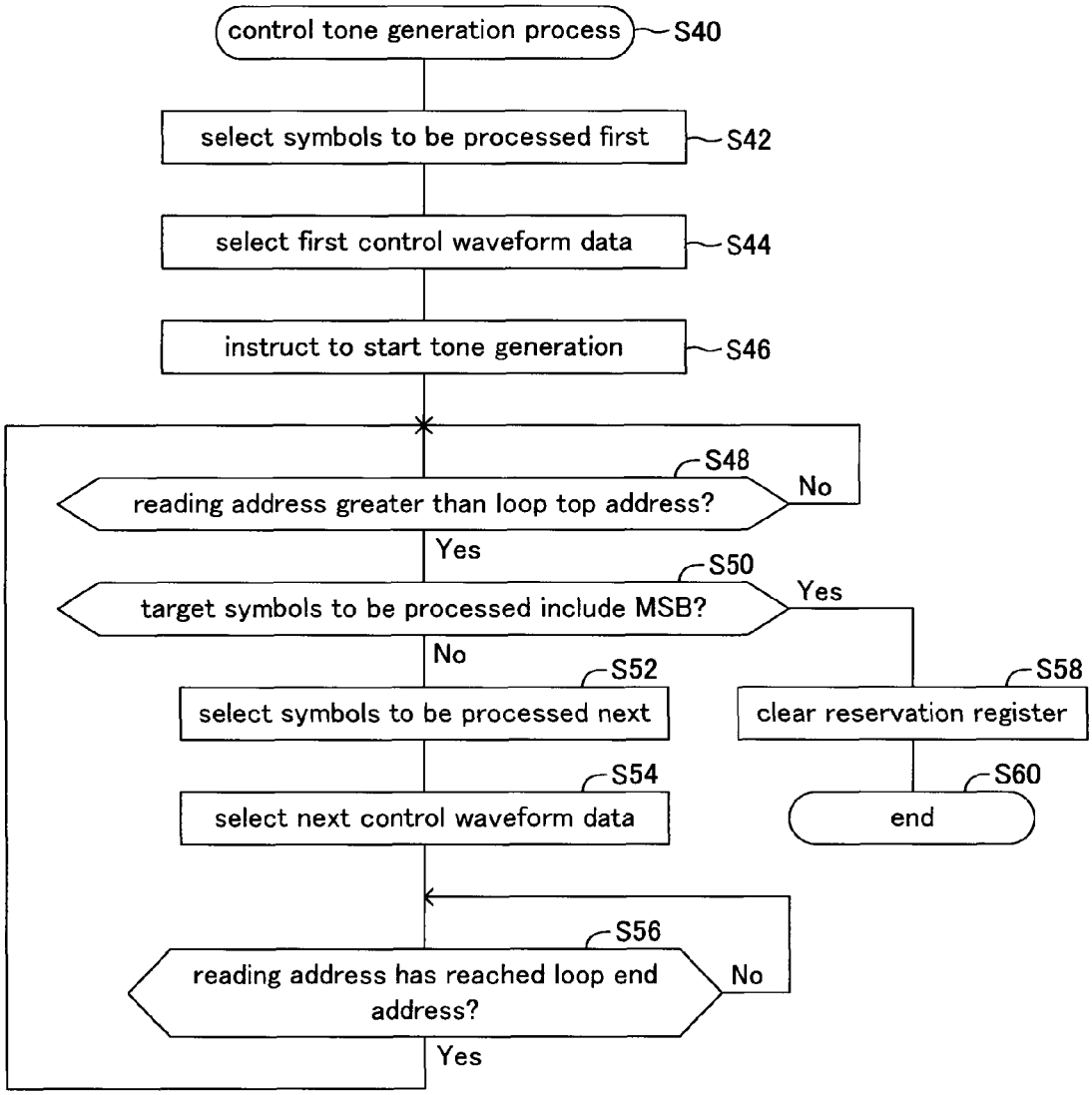
FIG. 15 is a flowchart of a control tone generation program.
Figure 16:
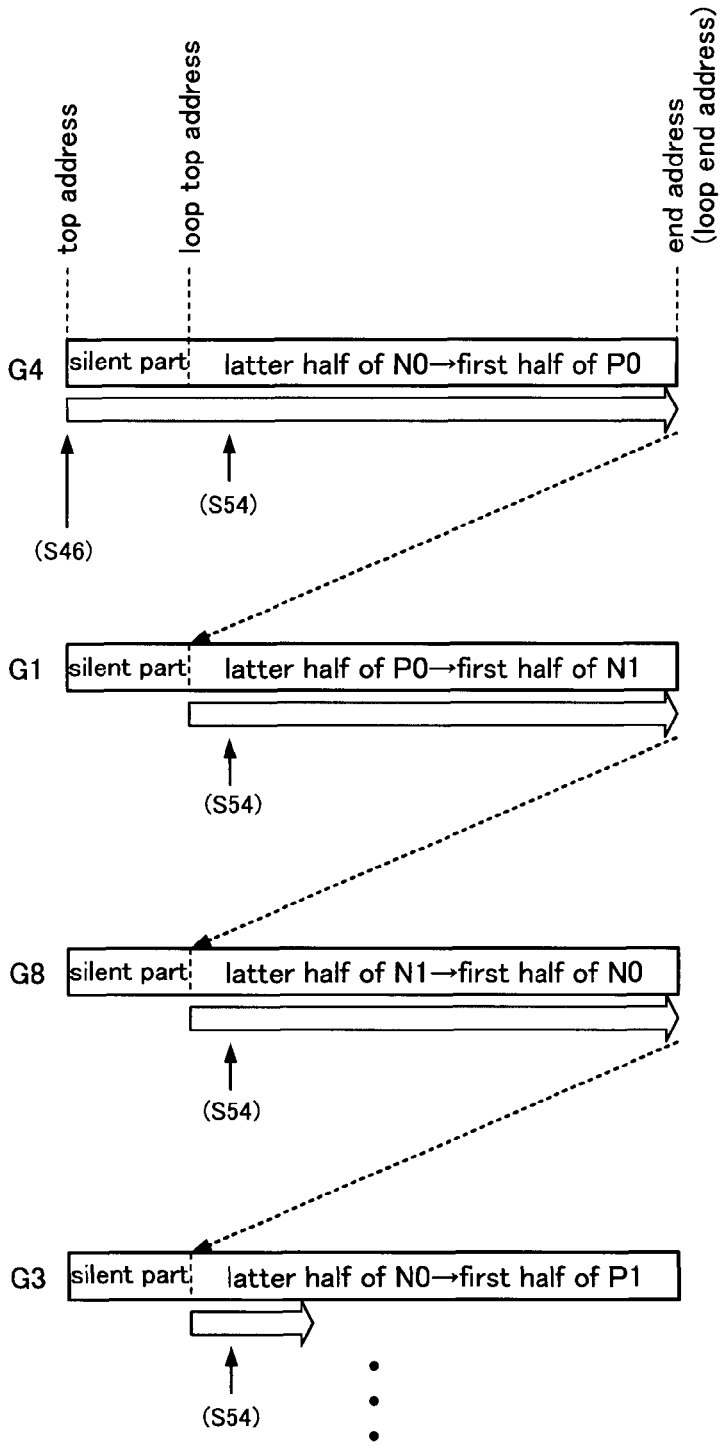
FIG. 16 is a diagram explaining an example of a control tone generation process.
Figure 21:
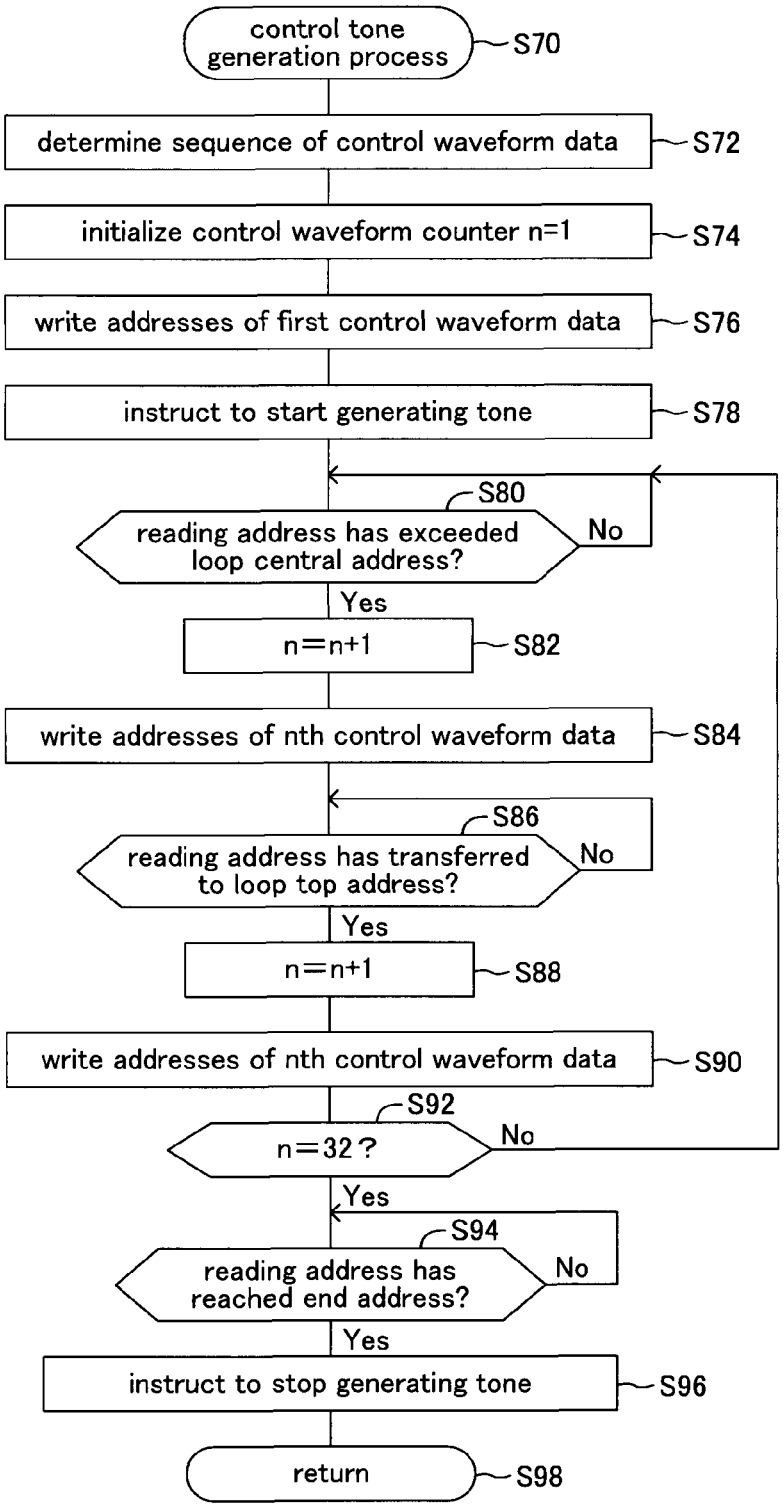
FIG. 21 is a flowchart of a control tone generation program according to the modification of the present invention.

In this case, a control tone generation program indicated in FIG. 21 is performed instead of the control tone generation program indicated in FIG. 15. More specifically, after starting the control tone generation process at step S70, the CPU 17*a* proceeds to step S72 to determine the sequence of control waveform data sets in accordance with the sequence of respective values of the symbols of musical score data SD. In an example indicated in FIG. 22, assume that the sequence of symbol values ranging from the least significant bit LSB side to the most significant bit MSB side of the musical score data SD is "0101 . . . ". In this case, the CPU 17*a* first selects control waveform data G41 corresponding to the 0th bit and the 1st bit of the musical score data SD as the first control waveform data. More specifically, the latter half of the basic waveform data g4 and the first half of the basic waveform data g1 which form the control waveform data G41 correspond to a value of the 0th bit of the musical score data SD. In addition, the latter half of the basic waveform data g1 and the first half of the basic waveform data g8 which forms the second control waveform data which will be described next correspond to a value of the 1st bit of the musical score data SD.

Next, the CPU 17*a* selects control waveform data G81 corresponding to respective values of the 1st bit and the 2nd bit of the musical score data SD, and the first control waveform data as the second control waveform data. Similarly to the first control waveform data, more specifically, the control waveform data G81 has the latter part which is basic waveform data g1. The first half of basic waveform data g8 which forms the control waveform data G81 corresponds to the latter half of the basic waveform data g1. Furthermore, the latter half of the basic waveform data g8 and the first half of basic waveform data g3 which forms the third control waveform data which will be described next correspond to a value of the 2nd bit of the musical score data SD.

Next, the CPU 17*a* selects control waveform data G83 corresponding to respective values of the 2nd bit and the 3rd bit of the musical score data SD, and the second control waveform data as the third control waveform data. Similarly to the second control waveform data, more specifically, the control waveform data G83 has the first part which is basic waveform data g8. Furthermore, the latter half of the basic waveform data g3 which forms the control waveform data G83 corresponds to a value of the 3rd bit of the musical score data SD.

Although the capacity of the musical score data SD is 4 byte (32 bits), the CPU 17*a* also makes selections for the 4th to 32nd control waveform data corresponding to neighboring two symbols situated at positions higher than the 3rd bit similarly to the above-described case of the 0th bit to the 3rd bit. More specifically, the CPU 17*a* makes selections of control waveform data so that the following four conditions will be satisfied. The first condition is that the control waveform data set is the data corresponding to target symbols of the musical score data. The second condition is that the latter part of an even-numbered control waveform data set is formed of a set of basic waveform data which forms the latter part of the immediately preceding odd-numbered control waveform data set, while the first part of an odd-numbered control waveform data set is formed of a set of basic waveform data which forms the first part of the immediately preceding even-numbered control waveform data set. The third condition is that the latter half of the basic waveform data set of the latter part of an even-numbered control waveform data and the first half of a basic waveform data set which forms the first part of the control waveform data correspond to the same differential code. The fourth condition is that the latter half of the basic waveform data set of the first part of an odd-numbered control waveform data and the first half of a basic waveform data set which forms the latter part of the control waveform data correspond to the same differential code.

Next, the reading of control waveform data will be explained. The CPU 17*a* initializes a control waveform counter "n" for identifying control waveform data which is currently being processed to "1" at step S74. At step S76, the CPU 17*a* writes addresses of the first control waveform data set into the processing register of the tone generation channel CH31 provided in the musical tone parameter input/output circuit 15*b*. In the example indicated in FIG. 22, the CPU 17*a* writes various addresses of control waveform data G41 into the processing register of the tone generation channel CH31 of the musical tone parameter input/output circuit 15*b*. The loop top address is an address corresponding to the end of a silent part. At step S78, the CPU 17*a* instructs the tone generation channel CH31 to start generating control tone by instructing the start of generation of digital tone signals by use of the first control waveform data.

At step S80, the CPU 17*a* judges whether the reading address exceeds the loop central address (the top address of the basic waveform data which is the latter one of the two sets of basic waveform data which form the control waveform data) of the nth control waveform data set. In a case where the reading address has not exceeded the loop central address of the nth control waveform data set, the CPU 17*a* gives "no", and carries out step S80 again. In a case where the reading address has exceeded the loop central address of the nth control waveform data set, the CPU 17*a* gives "yes", and increments the control waveform counter "n" at step S82. Because the control waveform counter "n" has been initialized to "1", in a case where the reading address has exceeded the loop central address of the control waveform data G41 which is the first control waveform data, the CPU 17*a* sets the control waveform counter at "2".

At step S84, the CPU 17*a* writes various addresses of the nth control waveform data into the processing register of the tone generation channel CH31 of the musical tone parameter input/output circuit 15*b*. The loop top address is the top address of a basic waveform data set which forms the first part of the nth control waveform data set. The loop end address is the end address of the nth control waveform data set. The address generation circuit ADR of the tone generation channel CH31 defines an address obtained by adding the top address of the nth control waveform data to the offset address as the reading address. The offset address will not be changed by the execution of step S84. As described above, an even-numbered control waveform data set and the immediately preceding odd-numbered control waveform data set have the latter part formed of the same basic waveform data set, without any change in the offset address before and after the change in the top address by step S84. Therefore, the address generation circuit ADR is able to continue the reading of the basic waveform data set.

Figure 22:
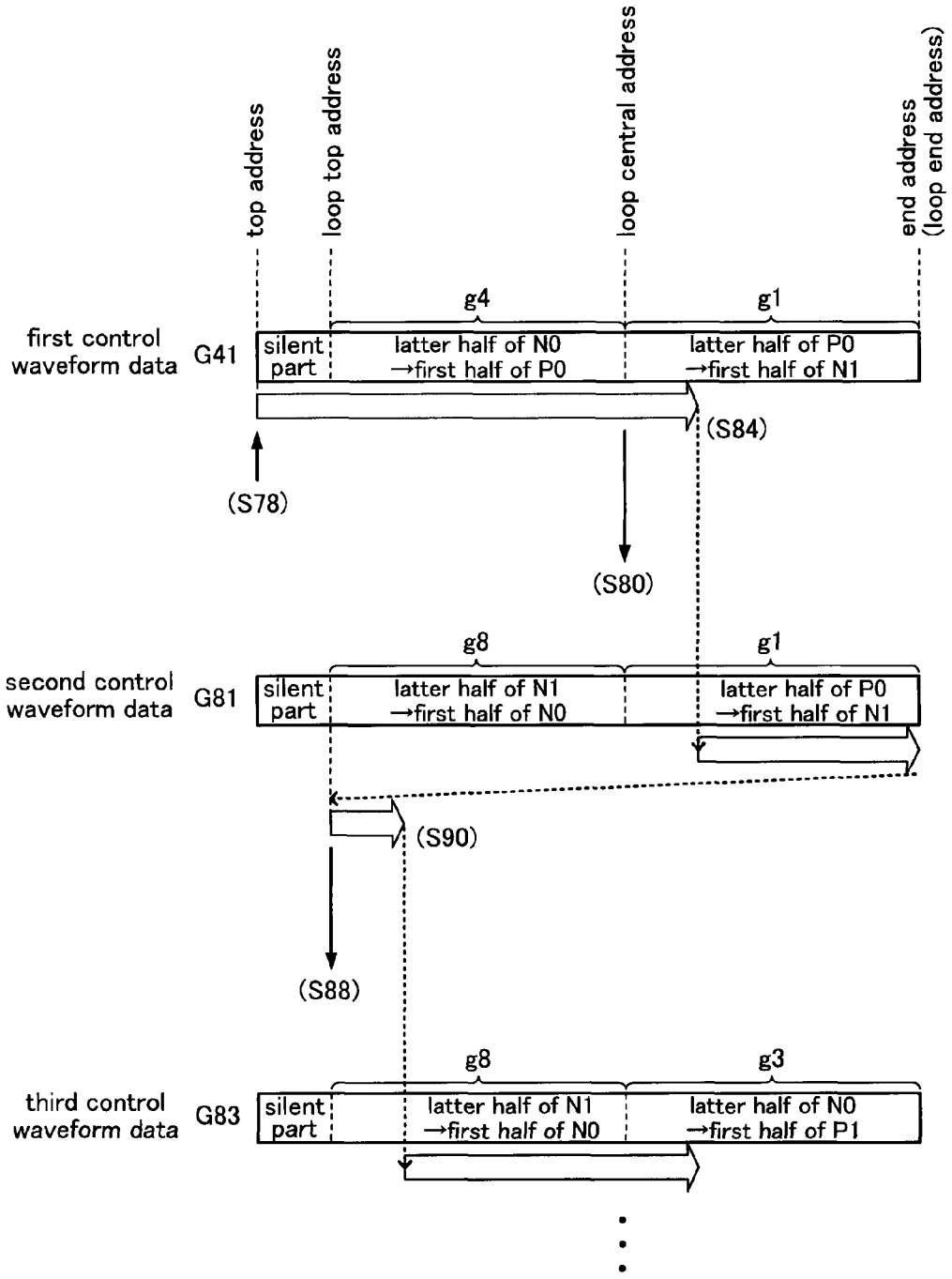
FIG. 22 is a diagram explaining an example of a control tone generation process according to the modification of the present invention.

In the example indicated in FIG. 22, for instance, the respective latter parts of the first control waveform data set and the second control waveform data set are formed of the basic waveform data set g1, so that the address generation circuit ADR is able to continue the reading of the basic waveform data set g1 before and after the execution of step S84. When the address generation circuit ADR has moved the reading address to the loop end address of the nth control waveform data set, the address generation circuit ADR sets the reading address of the next sampling period at the loop top address. In other words, the difference between the top address and the loop top address is set as the offset address. Then, the CPU 17*a* starts reading the basic waveform data set of the first part of the nth control waveform data set. In the example of FIG. 22, when the reading address has advanced to the loop end address of the control waveform data G81, the top address of the basic waveform data g8 which forms the first part of the control waveform data G81 is set as the reading address of the next sampling period.

At step S86, the CPU 17*a* judges whether the reading address has transferred from the end address to the loop top address. In a case where the reading address has not transferred from the end address to the loop top address, the CPU 17*a* gives "no", and carries out step S86 again.

In a case where the reading address has transferred from the end address to the loop top address, the CPU 17*a* gives "yes", and proceeds to step S88 to increment the control waveform counter "n". In the example of FIG. 22, in a case where the reading address has reached the end address of the second control waveform data to transfer the reading address to the top address of the basic waveform data g8 which forms the first part of the second control waveform data, the control waveform counter "n" is set at "3". At step S90, the CPU 17*a* writes various addresses of the nth control waveform data into the processing register of the musical tone parameter input/output circuit 15*b*. In this case, the loop top address is the top address of a basic waveform data which forms the first part of the nth control waveform data, while the loop end address is the end address of the nth control waveform data.

The address generation circuit ADR of the tone generation channel CH31 sets the reading address at an address obtained by adding the top address of the nth control waveform data to the offset address. In this case as well, the offset address will not be changed by the execution of the above-described step S90. As described above, an odd-numbered control waveform data set and the immediately preceding even-numbered control waveform data set have the first part formed of the same basic waveform data set, without any change in the offset address before and after the change in the top address by step S80. Therefore, the address generation circuit ADR is able to continue the reading of the basic waveform data set. In the example indicated in FIG. 22, for instance, the respective first parts of the second control waveform data set and the third control waveform data set are formed of the basic waveform data set g8, so that the address generation circuit ADR is able to continue the reading of the basic waveform data set g8 before and after the execution of step S90.

At step S92, the CPU 17*a* judges whether the value of the control waveform counter "n" is "32" to determine whether an instruction to generate control tones of 32 bits which form the musical score data SD has been accomplished. In a case where the value of the control waveform counter "n" is not "32", the CPU 17*a* gives "no", and proceeds to step S80. In a case where the value of the control waveform counter "n" is "32", the CPU 17*a* gives "yes", and proceeds to step S94 to judge whether the reading address has reached the end address of the nth control waveform data. In a case where the reading address has not reached the end address of the nth control waveform data yet, the CPU 17*a* gives "no", and carries out step S94 again. In a case where the reading address has reached the end address of the nth control waveform data, the CPU 17*a* gives "yes", proceeds to step S96 to instruct the tone generation channel CH31 to stop generating digital tone signals to stop the generation of control tones, and further proceeds to step S98 to terminate the control tone generation process to return to the automatic performance process.

Unlike the above-described embodiment, this modification does not require the reservation register, simplifying the configuration of the musical tone parameter input/output circuit 15*b*.

Figure 23A:
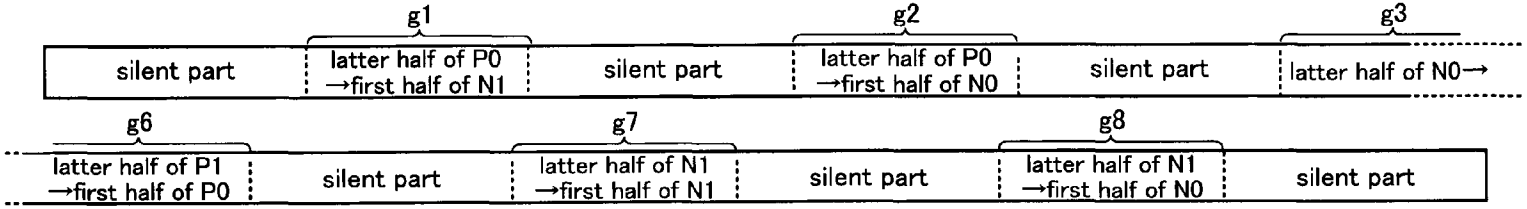
FIG. 23A is a memory map indicative of an arrangement of control waveform data sets according to a different modification of the present invention.
Figure 23B:
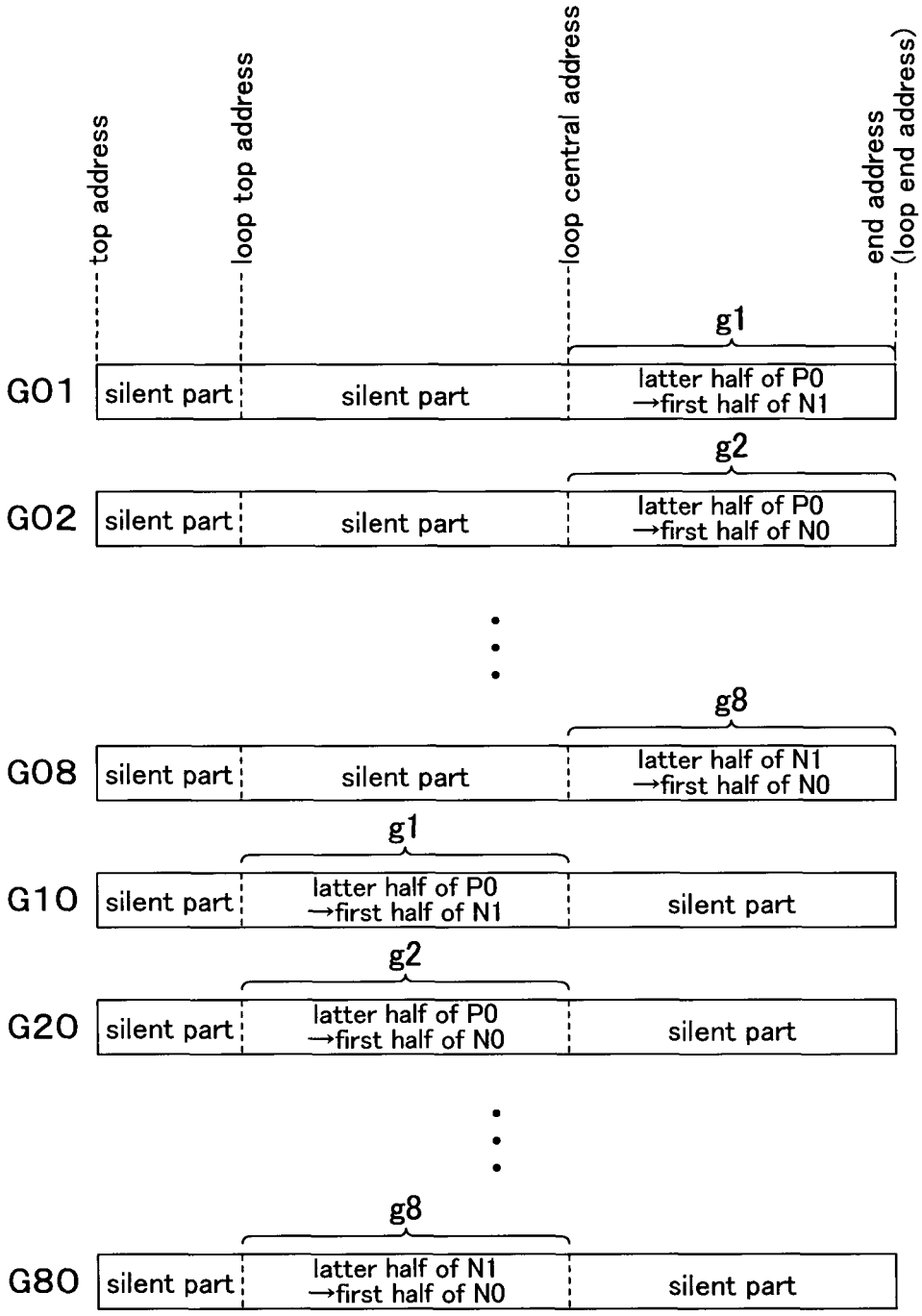
FIG. 23B is a diagram indicative of respective configurations of the control waveform data sets according to the different modification of the present invention.

As indicated in FIG. 23A and FIG. 23B, furthermore, the waveform memory WM may store control waveform data sets G01 to G08 in each of which a silent part of the same length as the basic waveform data sets g1 to g8 is provided in front of each of the basic waveform data sets g1 to g8, with a short silent part being further provided in front of each of the silent part, and control waveform data sets G10 to G80 in each of which a silent part which is the same length as the basic waveform data g1 to g8 is provided behind each of the basic waveform data sets g1 to g8, with a short silent part being further provided in front of each of the basic waveform data sets g1 to g8. The control waveform data sets G01 to G08 and the control waveform data sets G10 to G80 have the short silent part of the same length provided at the top of the data. Similarly, to the above-described embodiment, however, the short silent part may not be provided.

In this case, the basic waveform data sets g1 to g8 and the silent parts are stored alternately at continuous addresses in the waveform memory WM. The length of the silent parts is the length obtained by combining the length of the silent part having the same length as the basic waveform data set and the length of the short silent part provided at the top of the control waveform data set. By designating the top address and the end address so that the silent parts will be situated in front of the basic waveform data g1 to g8, any one of the control waveform data sets G01 to G08 will be selected. By designating the top address and the end address so that the silent parts will be situated in front of and behind the basic waveform data g1 to g8, any one of the control waveform data sets G10 to G80 will be selected.

In this case, unlike the above-described embodiment and its modification, the tone generation channel CH30 and the tone generation channel CH31 are used for the generation of control tones. More specifically, when the musical performance apparatus 10 is in the control mode for controlling the musical score display apparatus 20, the tone generation channel CH30 and the tone generation channel CH31 are designated as channels for generating digital tone signals representative of control tones, so that the digital tone signals output from the tone generation channel CH30 and the tone generation channel CH31 are output not to the effect process circuit 15*a*2 but only to the tone volume adjustment circuit 15*a*3. Similarly to the above-described embodiment, furthermore, the value of the tone volume setting parameter which will be supplied to the tone volume adjustment circuit 15*a*3 for control tones is a fixed value (e.g., maximum value "127"). In addition, the value of a pan setting parameter which will be supplied to the pan adjustment circuit 15*a*4 for control tones is also a fixed value (e.g., a set value output only from the left speaker).

Figure 24:
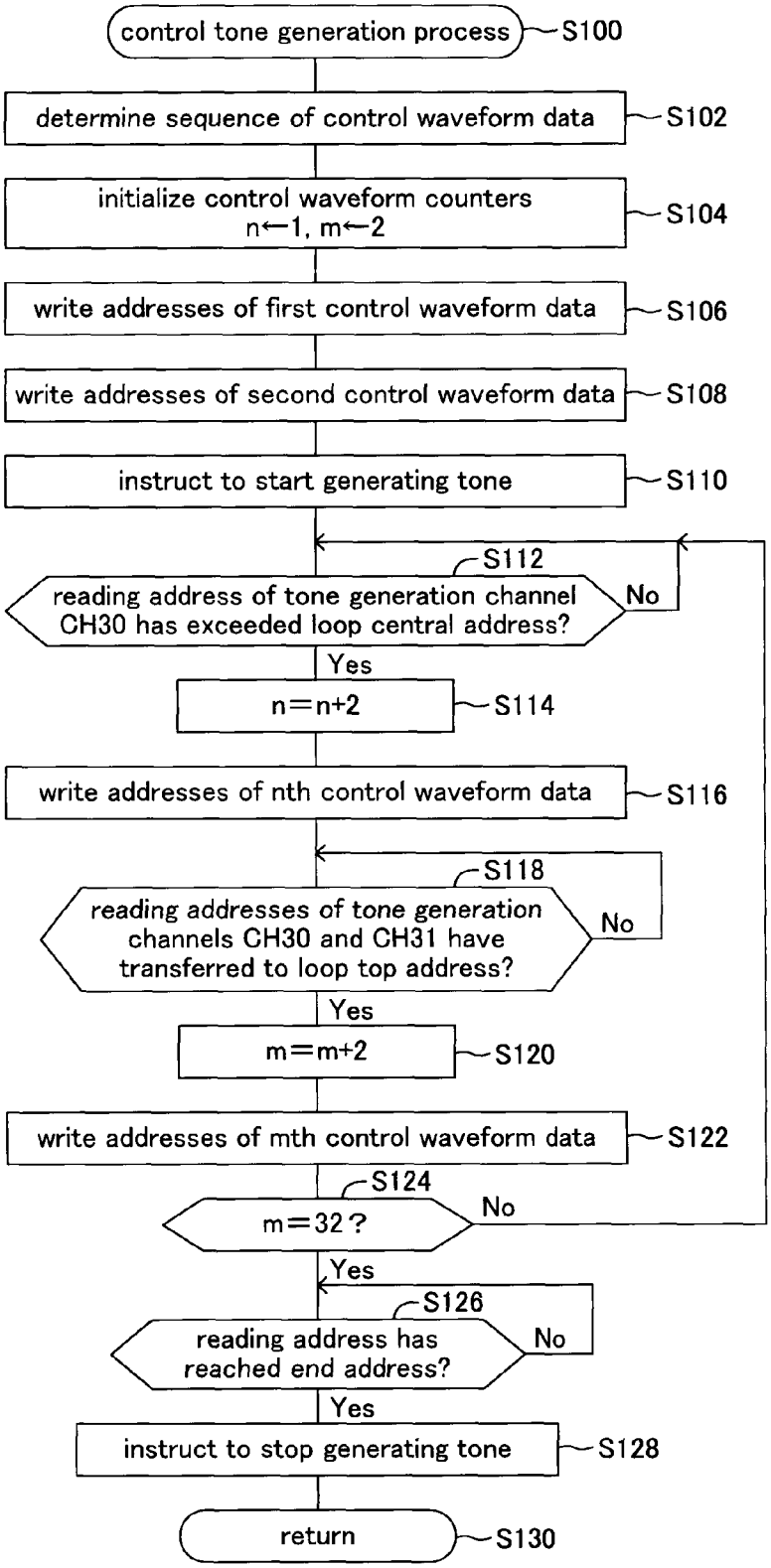
FIG. 24 is a flowchart of a control tone generation program according to the different modification of the present invention.

In this case, the CPU 17*a* carries out a control tone generation program indicated in FIG. 24 instead of the control tone generation program of FIG. 15. After starting the control tone generation process at step S100, the CPU 17*a* determines the sequence of the control waveform data sets in accordance with the sequence of symbol values of musical score data SD at step S102. In an example indicated in FIG. 25, assume that the sequence of symbol values ranging from the least significant bit LSB side to the most significant bit MSB side of the musical score data SD is "0101 . . . ". In this case, the CPU 17*a* first selects control waveform data G40 corresponding to the 0th bit and the 1st bit of the musical score data SD as the first control waveform data, and selects control waveform data G01 as the second waveform data. The first control waveform data is read out by the tone generation channel CH30, while the second first control waveform data is read out by the tone generation channel CH31. The latter half of basic waveform data g4 which forms the control waveform data G40 and the first half of basic waveform data g1 which forms the control waveform data G01 correspond to the value of the 0th bit of the musical score data SD. Furthermore, the latter half of basic waveform data g1 and the first half of basic waveform data g8 which forms the third control waveform data which will be explained next correspond to the value of the 1st bit of the musical score data SD.

Next, the CPU 17*a* selects control waveform data G80 corresponding to respective values of the 1st bit and the 2nd bit of the musical score data SD, and the first control waveform data as the third control waveform data, and selects control waveform data G03 as the fourth control waveform data. The third control waveform data is read out by the tone generation channel CH30, while the fourth first control waveform data is read out by the tone generation channel CH31. The latter half of basic waveform data g8 which forms the control waveform data G80 and the first half of basic waveform data g3 which forms the control waveform data G03 correspond to the value of the 2nd bit of the musical score data SD.

Although the capacity of the musical score data SD is 4 byte (32 bits), the CPU 17*a* also makes selections for the 5th to 32nd control waveform data corresponding to neighboring two symbols situated at positions higher than the 3rd bit similarly to the above-described case of the 0th bit to the 2nd bit. More specifically, the latter part of an odd-numbered control waveform data is a silent part, while the first part of an even-numbered control waveform data is a silent part. The CPU 17*a* then makes selections such that the latter half of a basic waveform data set which forms the first part of an odd-numbered control waveform data and the first half of a basic waveform data set which forms the latter part of the subsequent even-numbered control waveform data correspond to a symbol of the musical score data SD, while the latter half of a basic waveform data set which forms the latter part of the even-numbered control waveform data and the first half of the further subsequent odd-numbered control waveform data correspond to another symbol of the musical score data SD.

Figure 25:
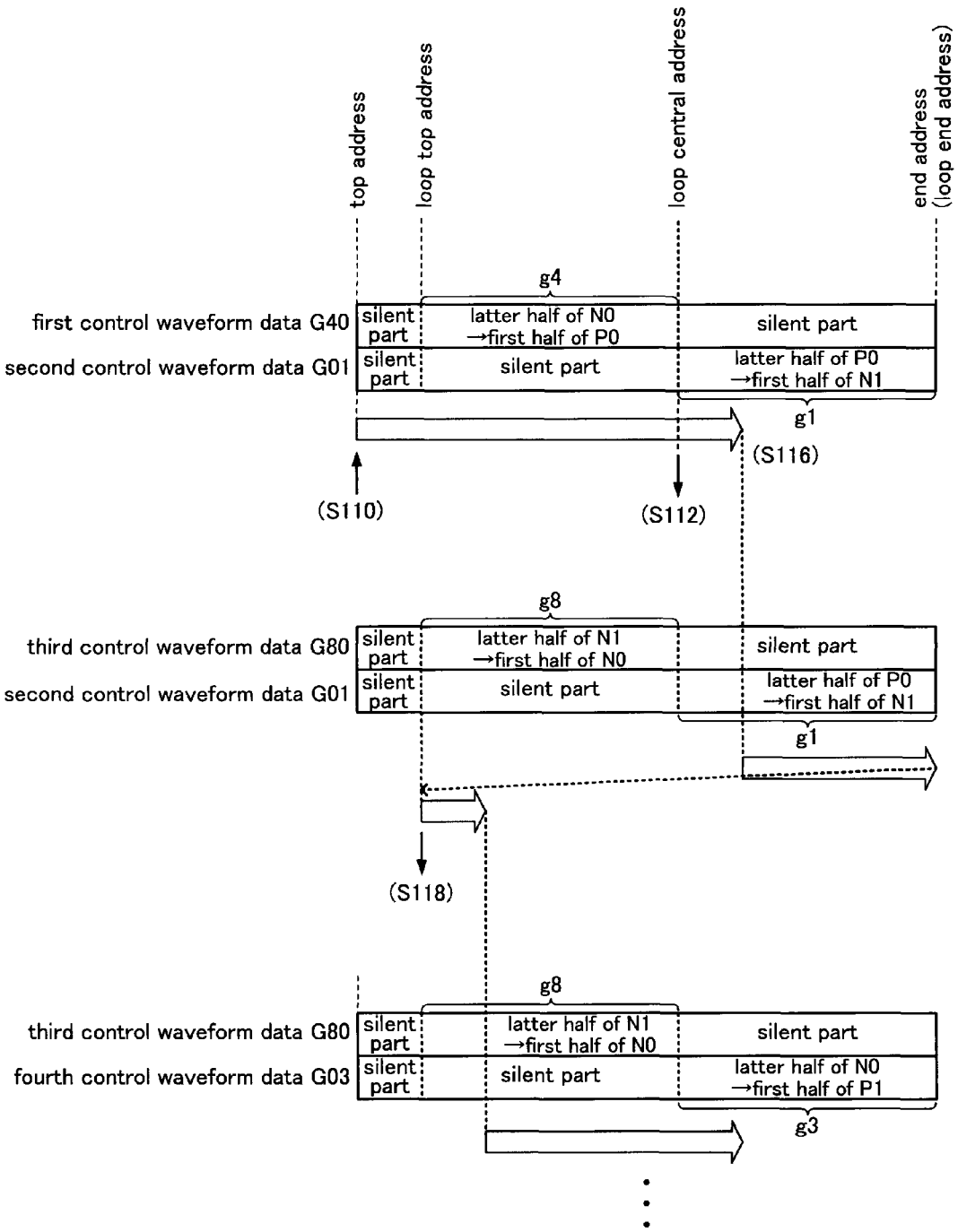
FIG. 25 is a diagram explaining an example of a control tone generation process according to the different modification of the present invention.

At step S104, the CPU 17*a* initializes the control waveform counter "n" for identifying control waveform data which is currently being processed by the tone generation channel CH30 to "1", and also initializes a control waveform counter "m" for identifying control waveform data which is currently being processed by the tone generation channel CH31 to "2". At step S106, the CPU 17*a* writes addresses of the first control waveform data set into the processing register of the tone generation channel CH30 provided in the musical tone parameter input/output circuit 15*b*. The loop top address is the top address of the basic waveform data set which forms the first control waveform data. The loop end address is the end address. In the example of FIG. 25, various addresses of the control waveform data G40 is written into the processing register of the tone generation channel CH30 of the musical tone parameter input/output circuit 15*b*.

At step S108, the CPU 17*a* writes various addresses of the second control waveform data into the processing register of the tone generation channel CH31 of the musical tone parameter input/output circuit 15*b*. The loop top address is an address corresponding to the top of the silent part which is provided in front of the basic waveform data set which forms the second control waveform data and has the same length as the basic waveform data set. The loop end address is the end address. In the example of FIG. 25, various addresses of the control waveform data G01 is written into the processing register of the tone generation channel CH31 of the musical tone parameter input/output circuit 15*b*.

At step S110, the CPU 17*a* instructs the tone generation channel CH30 and the tone generation channel CH31 to start generating digital tone signals by use of the first control waveform data and the second control waveform data to concurrently start generation of control tones at the both channels. Because the first part of the second control waveform data is a silent part, only the tone generation channel CH30 will generate tones first.

At step S112, the CPU 17*a* judges whether the reading address of the tone generation channel CH30 exceeds the loop central address (the address corresponding to the top of the silent part added behind the basic waveform data which forms the control waveform data) of the nth control waveform data set. In a case where the reading address of the tone generation channel CH30 has not exceeded the loop central address of the nth control waveform data set, the CPU 17*a* carries out step S112 again. In a case where the reading address of the tone generation channel CH30 has exceeded the loop central address of the nth control waveform data set, the CPU 17*a* adds "2" to the control waveform counter "n" at step S114.

At step S116, the CPU 17*a* writes various addresses of the nth control waveform data into the processing register of the tone generation channel CH30 of the musical tone parameter input/output circuit 15*b*. In this case, the loop top address is the top address of a basic waveform data set which forms the nth control waveform data set. The loop end address is the end address. Because the control waveform counter "n" has been initialized to "1", in a case where the reading address has exceeded the loop central address of the first control waveform data, the CPU 17*a* sets the control waveform counter "n" at "3" at step S114. At step S116, the CPU 17*a* writes various addresses of the third control waveform data into the processing register of the tone generation channel CH30 of the musical tone parameter input/output circuit 15*b*. In the example indicated in FIG. 25, in a case where the reading address has exceeded the loop central address of the control waveform data G40, the CPU 17*a* writes various addresses of the control waveform data G80 into the processing register of the tone generation channel CH30 of the musical tone parameter input/output circuit 15*b*.

The address generation circuit ADR of the tone generation channel CH30 defines an address obtained by adding the top address to the offset address as the reading address. The offset address will not be changed by the execution of step S116. As described above, an odd-numbered control waveform data set has the latter part formed of a silent part, without any change in the offset address before and after the change in the top address by step S116. Therefore, the address generation circuit ADR of the tone generation channel CH30 is able to continue the reading of the waveform data representative of the silent part immediately after the execution of step S116. In the example of FIG. 25, because the respective latter parts of the control waveform data G40 and the control waveform data G80 are formed of a silent part, the address generation circuit ADR of the tone generation channel CH30 switches from the reading of the silent part of the control waveform data G40 to the reading of the silent part of the control waveform data G80 by the first execution (n=3) of step S116.

When the reading address of the tone generation channel CH30 exceeds the loop central address of the nth control waveform data, the reading address of the tone generation channel CH31 also exceeds the loop central address of the mth control waveform data. As a result, the address generation circuit ADR of the tone generation channel CH31 starts reading the basic waveform data which forms the latter part of the mth control waveform data. In the example of FIG. 25, after the first execution (m=2) of step S116, the address generation circuit ADR of the tone generation channel CH31 starts reading the basic waveform data g1 which forms the latter part of the second control waveform data.

When the address generation circuit ADR of the tone generation channel CH30 has moved the reading address to the loop end address of the nth (=m+1) control waveform data set, the address generation circuit ADR sets the reading address of the next sampling period at the loop top address. In other words, the difference between the top address and the loop top address is set as the offset address. Then, the CPU 17*a* starts reading the basic waveform data set which forms the first part of the nth control waveform data set. In a case where the control waveform counter "n" is "3" in the example of FIG. 25, when the reading address has advanced to the end of the control waveform data G80, the top address of the basic waveform data g8 is set as the reading address of the next sampling period. When the address generation circuit ADR of tone generation channel CH31 has moved the reading address to the loop end address of the mth control waveform data set, the address generation circuit ADR sets the reading address of the next sampling period at the loop top address. Then, the CPU 17*a* starts reading the silent part which forms the first part of the mth control waveform data set. Therefore, only the tone generation channel CH30 emits tones. In a case where the control waveform counter "n" is "2" in the example of FIG. 25, when the reading address has moved to the end of the control waveform data G01, the reading address of the next sampling period is set at the address corresponding to the top of the silent part which is provided in front of the basic waveform data g1 and has the same length as the basic waveform data g1.

At step S118, the CPU 17*a* judges whether the respective reading addresses of the tone generation channel CH30 and the tone generation channel CH31 have transferred from the loop end address to the loop top address. In a case where the reading addresses have not transferred from the loop end address to the loop top address, the CPU 17*a* gives "no", and carries out step S118 again.

In a case where the reading addresses of the tone generation channel CH30 and the tone generation channel CH31 have transferred from the loop end address to the loop top address, the CPU 17*a* gives "yes", and proceeds to step S120 to add "2" to the control waveform counter "m". At step S122, the CPU 17*a* writes various addresses of the mth control waveform data into the processing register of the musical tone parameter input/output circuit 15*b* provided for the tone generation channel CH31. In this case, the loop top address is an address corresponding to the end of the silent part provided at the top of the data, while the loop end address is the end address of the mth control waveform data.

Because the control waveform counter "m" has been initialized to "2", in a case where the reading address has transferred from the loop end address to the loop top address, the CPU 17*a* sets the control waveform counter "m" at "4" at step S120, and writes various addresses of the fourth control waveform data into the processing register of the tone generation channel CH31 provided in the musical tone parameter input/output circuit 15*b* at step S122. In the example of FIG. 25, in a case where the reading address has transferred from the loop end address of the control waveform data G01 to the loop top address, the CPU 17*a* writes various addresses of the control waveform data G03 into the processing register of the tone generation channel CH31 provided in the musical tone parameter input/output circuit 15*b*.

The address generation circuit ADR of the tone generation channel CH31 sets the reading address at an address obtained by adding the top address of the mth control waveform data to the offset address. In this case as well, the offset address will not be changed by the execution of the above-described step S122. As described above, an even-numbered control waveform data set has the first part formed of a silent part, without any change in the offset address before and after the change in the top address by step S122. Therefore, the address generation circuit ADR of the tone generation channel CH31 reads out the silent part of the mth (=n+1) control waveform data. In the example indicated in FIG. 25, because the respective first parts of the control waveform data G01 and the control waveform data G03 are formed of a silent part, the address generation circuit ADR of the tone generation channel CH31 switches the reading from the silent part of the control waveform data G01 to the silent part of the control waveform data G03 at the first execution (m=4) of step S122. At this time, the address generation circuit ADR of the tone generation channel CH30 has started reading basic waveform data g8 which forms the third control waveform data.

At step S124, the CPU 17*a* judges whether the value of the control waveform counter "n" is "32" to determine whether an instruction to generate control tones of 32 bits which form the musical score data SD has been accomplished. In a case where the value of the control waveform counter "n" is not "32", the CPU 17*a* gives "no", and proceeds to step S112. In a case where the value of the control waveform counter "n" is "32", the CPU 17*a* gives "yes", and proceeds to step S126 to judge whether the reading address has reached the end address of the nth control waveform data. In a case where the reading address has not reached the end address of the nth control waveform data yet, the CPU 17*a* gives "no", and carries out step S126 again. In a case where the reading address has reached the end address of the nth control waveform data, the CPU 17*a* gives "yes", proceeds to step S128 to instruct the tone generation channel CH31 to stop generating digital tone signals to stop the generation of control tones, and further proceeds to step S130 to terminate the control tone generation process to return to the automatic performance process.

Similarly to the example explained with reference to FIGS. 19A to 22, this modification does not require the reservation register, simplifying the configuration of the musical tone parameter input/output circuit 15*b*.

Because the control waveform data sets G1 to G8 have the same data length, the above-described embodiment may be modified such that only the top address is written into the processing register and the reservation register without end address (i.e., loop end address) being written so that an offset address corresponding to the data length of the control waveform data G1 to G8 will be added to the top address to figure out an end address. Furthermore, because the silent parts provided at the top of the respective control waveform data sets G1 to G8 have the same data length, a loop top address may be figured out by adding an offset address corresponding to the data length of the silent part to a top address.

The format of the musical score data SD is not limited to that of the above-described embodiment and its modifications, but can be any format. Furthermore, the target which is to be controlled by the control tones emitted by the musical performance apparatus 10 is not limited to the musical score display apparatus 20, but can be any external apparatus as long as it is used along with the musical performance apparatus 10.

In the above-described embodiment and its modifications, the tone generation channel CH30 and the tone generation channel CH31 are the tone generation channels which generate digital tone signals representative of control tones. However, channels other than the above-described channels may be used as tone generation channels for generating digital tone signals representative of control tones. In the single mode, furthermore, in a case where the musical performance apparatus 10 is transferred to the control mode during generation of digital tone signals representative of musical tones by use of some of the tone generation channels, the CPU 17*a* may select tone generation channels which are not being used for the generation of the musical tones or tone generation channels generating digital tone signals of the musical tones which are currently being generated but whose tone volume is sufficiently low, and designate the selected tone generation channels as tone generation channels which are to generate digital tone signals representative of control tones.

The modulation scheme (control tone generating scheme) performed by the control waveform data generating apparatus WP is not limited to that of the above-described embodiment and its modifications, but can be any schemes.

In the above-described embodiment and its modifications, the differential phase modulation portion WP2 performs the differential binary phase shift keying (DBPSK) which is the scheme to output the differential codes in accordance with the sequence of the values of the chips output from the spreading process portion WP1. The embodiment can be modified such that the differential phase modulation portion WP2 selects neighboring chips two by two which form the signal output from the spreading process portion WP1 stating with top chip toward the last chip, and determine the value of the next chip in accordance with the values of the selected chips. In other words, the differential phase modulation portion WP2 may perform the differential quadrature phase shift keying (DQPSK).

Furthermore, the spreading process can be canceled. In this case, a symbol which will be transmitted may be directly converted into differential codes without being spread.

Furthermore, the conversion into differential codes can be canceled. In this case, the carrier wave may be modulated in accordance with the values of the chips which are output from the spreading process portion WP1.

Furthermore, the spreading process and the conversion into differential codes can be canceled. In this case, the waveform data generating apparatus WP may be vary amplitude or phase of the carrier wave in accordance with symbol value. In case that the conversion into differential code is canceled, synchronization signals representative of the timing for detecting the control tone may be separately transmitted from the musical performance apparatus 1 to the musical score display apparatus 20.

Furthermore, the Hilbert transform potion WP4 of the waveform data generating apparatus WP transforms the differential codes so that the upper sideband of the frequency band of the differential code can be extracted. By reducing the frequency band of the differential code as described above, the embodiment reduces influence caused by noise. In case the control tone has a sufficiently wide bandwidth or noise has very low amplitude, the Hilbert transform processing can be canceled and the control tone may be formed of frequency components included in the both sideband.

Furthermore, the modulation scheme performed by the pass band modulation portion WP5 is not limited to that of the above-described embodiment and its modifications, but can be any schemes. For instance, the amplitude shift keying or the frequency shift keying can be employed. In this case, the pass band modulation portion WP5 may modulate the carrier wave in accordance with the value of each bit which forms the signal which is input into the pass band modulation portion WP5, or may modulate carrier wave in accordance with the values of a plurality of bits which form the signal. For instance, the On/Off modulation scheme which is a sort of the amplitude shift keying is employed. In this case, the pass band modulation portion WP5 switches on/off the carrier wave in accordance with the value of signal which is input into the pass band modulation portion WP5 and may output a signal like Morse signal.

In case the modulation scheme which is different from that of above-described embodiment or its modifications is employed, the score display apparatus 20 may perform the decode processing by the scheme corresponding to the modulation scheme which is employed in the musical performance apparatus 10.

Furthermore, the waveform data extraction portion WP7 extracts a basic waveform data so that a part at which differential codes switch is assumed as a center of the basic waveform data. This prevents that the waveform of the control tone has a discontinued part which corresponds to the boundaries of the differential codes. However, in case that the accuracy of the decoding of the score data SD will not be influenced by the discontinued part, the waveform data extraction portion WP7 extracts a basic waveform data corresponding to a symbol (differential code type). More specifically, the waveform data extraction portion WP7 may extract a basic waveform data so that the basic waveform data will not straddle a boundary between differential codes. In this case, the CPU 17*a* converts a symbol which forms the score data SD which will be transmitted to a differential code, and selects basic waveform data corresponding to the sequence of the differential code. The CPU 17*a* may instruct to the tone generation circuit 15 to reproduce the control tone corresponding to the waveform data selected as described above.

What is claimed is:

1. A musical performance apparatus comprising:

a tone generating portion configured to emit a musical tone of a musical instrument and a control tone which is formed only of a frequency component included in a certain high frequency band and corresponds to control data for controlling an external apparatus, and including a tone volume changing portion configured to change tone volume only of the musical tone in accordance with player's instruction while maintaining tone volume of the control tone at a certain tone volume, wherein a first mode in which only the musical tone is emitted and a second mode in which the musical tone and the control tone are emitted are provided, the tone generating portion includes a plurality of tone generation channels to generate the musical tone or the control tone so that all of the tone generation channels will generate the musical tone in the first mode while at least one of the tone generation channels will generate the control tone in the second mode, the at least one of the tone generation channels being configured to read out waveform data from a memory and generate the control tone based on the read out waveform data, and the tone generation portion further includes a plurality of tone volume adjustment circuits configured to respectively receive an output from the tone generation channels, and in the second mode, a tone volume adjustment circuit connected to the at least one of the tone generation channels has a non-adjustable value for a tone volume setting parameter while the other of the tone volume adjustment circuits have an adjustable value for the tone volume setting parameter.

2. The musical performance apparatus according to claim 1, wherein the tone generating portion includes:

a plurality of speakers for emitting the musical tone and the control tone; and a localization setting portion configured to localize a sound image of the control tone at a certain position by setting respective tone volumes of the control tone which is to be emitted from the speakers at certain tone volumes, respectively.

3. The musical performance apparatus according to claim 2, wherein the localization setting portion allows the control tone to be emitted only from one speaker which is selected from the plurality of speakers.

4. The musical performance apparatus according to claim 1, wherein tone volume of a frequency component which is included in frequency components of the musical tone and is further included in the certain high frequency band is lower than the tone volume of the control tone.

5. The musical performance apparatus according to claim 1, wherein the control tone is a modulated tone obtained by modulating a carrier wave by use of the control data.

6. The musical performance apparatus according to claim 1, wherein the tone generating portion further includes a tone pitch changing portion configured to change a tone pitch only of the musical tone in accordance with the player's instruction while maintaining a tone pitch of the control tone at a certain tone pitch.

7. The musical performance apparatus according to claim 1, wherein the tone generating portion further includes a tone color changing portion configured to change a tone color only of the musical tone in accordance with the player's instruction while maintaining tone color of the control tone at a certain tone color.

8. The musical performance apparatus according to claim 1, wherein the external apparatus includes a display unit to display a score; and the control data includes a score page designating data which designates a page position of the score to be displayed on the display unit.

9. The musical performance apparatus according to claim 8, wherein the score page designating data is generated by spreading the data representative of the page position of the score to be displayed on the display unit and modulating the spread data by using differential phase shift modulation scheme.

* * * * *